US007948304B2

(12) United States Patent
Aruga et al.

(10) Patent No.: US 7,948,304 B2
(45) Date of Patent: May 24, 2011

(54) CONSTANT-VOLTAGE GENERATING CIRCUIT AND REGULATOR CIRCUIT

(75) Inventors: Kenta Aruga, Shinjuku (JP); Suguru Tachibana, Shinjuku (JP); Koji Okada, Shinjuku (JP)

(73) Assignee: Fujitsu Semiconductor Limited, Yokohama (JP)

( * ) Notice: Subject to any disclaimer, the term of this patent is extended or adjusted under 35 U.S.C. 154(b) by 0 days.

(21) Appl. No.: 12/619,496

(22) Filed: Nov. 16, 2009

(65) Prior Publication Data

US 2010/0188141 A1 Jul. 29, 2010

(30) Foreign Application Priority Data

Jan. 26, 2009 (JP) ..... 2009-014339

(51) Int. Cl.
*G05F 1/10* (2006.01)

(52) U.S. Cl. ..... 327/539; 327/513

(58) Field of Classification Search ..... 327/539, 327/513; 323/313
See application file for complete search history.

(56) References Cited

U.S. PATENT DOCUMENTS

| | | | | |
|---|---|---|---|---|
| 5,258,664 | A | 11/1993 | White | |
| 5,352,972 | A * | 10/1994 | Pernici et al. | 323/313 |
| 5,867,012 | A * | 2/1999 | Tuthill | 323/313 |
| 6,060,874 | A * | 5/2000 | Doorenbos | 323/316 |
| 6,462,612 | B1 | 10/2002 | Roh | |
| 6,788,131 | B1 * | 9/2004 | Huang | 327/539 |
| 6,819,163 | B1 * | 11/2004 | Gregoire, Jr. | 327/536 |
| 7,112,948 | B2 * | 9/2006 | Daly et al. | 323/316 |
| 7,230,473 | B2 * | 6/2007 | Tadeparthy et al. | 327/539 |
| 7,236,047 | B2 * | 6/2007 | Tachibana et al. | 327/539 |
| 7,342,390 | B2 | 3/2008 | Tachibana | |
| 7,429,129 | B2 * | 9/2008 | St. Pierre et al. | 374/178 |
| 7,583,135 | B2 * | 9/2009 | Ashburn et al. | 327/539 |
| 7,586,371 | B2 * | 9/2009 | Tachibana et al. | 330/253 |
| 7,834,611 | B2 * | 11/2010 | Kim et al. | 323/317 |
| 2007/0013436 | A1 * | 1/2007 | Chou | 327/539 |

FOREIGN PATENT DOCUMENTS

| | | | |
|---|---|---|---|
| JP | H06-244656 | A | 9/1994 |
| JP | 3273786 | B | 2/2002 |
| JP | 2004-80581 | A | 3/2004 |
| JP | 2007-299294 | A | 11/2007 |

OTHER PUBLICATIONS

Shyu, Yen-Shyung et al., "A 0.99μA Operating Current Li-Ion Battery Protection IC", *IEICE Transactions on Electronics*, vol. 1. E85-C, No. 5 May 2002, 1211-1215.

Weng, Ming-Chan et al.,"Low Cost CMOS On-Chip and Remote Temperature Sensors",*IEICE Transactions on Electronics*. vol. E84-C, No. 4 Apr. 2001, 451-459.

* cited by examiner

*Primary Examiner* — Thomas J Hiltunen
(74) *Attorney, Agent, or Firm* — Fujitsu Patent Center

(57) ABSTRACT

A constant-voltage generating circuit includes: a reference potential generating unit; first and second amplifier units whose outputs are respectively connected to the output line; and a low-pass filter, and wherein first and second operation periods are repeated, one alternating with the other, the first amplifier unit stores offset voltage of the first amplifier unit during the second operation period, and produces an output, during the first operation period, that brings the first potential and the second potential equal to each other by canceling out the offset voltage using the stored offset voltage, and the second amplifier unit stores offset voltage of the second amplifier unit during the first operation period, and produces an output, during the second operation period, that brings the first potential and the second potential equal to each other by canceling out the offset voltage using the stored offset voltage.

19 Claims, 22 Drawing Sheets

CONSTANT-VOLTAGE GENERATING CIRCUIT AND REGULATOR CIRCUIT

CROSS-REFERENCE TO RELATED APPLICATIONS

This application is based upon and claims the benefit of priority of the prior Japanese Patent Application No. 2009-014339, filed on Jan. 26, 2009, the entire contents of which are incorporated herein by reference.

FIELD

The embodiments described herein relate to a constant-voltage generating circuit and a regulator circuit using the same.

BACKGROUND

In an analog integrated circuit, a reference voltage circuit (constant-voltage generating circuit) called a bandgap circuit has widely been used when it is required to provide a constant reference voltage that does not depend on temperature or supply voltage. Since it can be easily combined with a digital circuit, the bandgap circuit has also been used widely as a stable reference voltage circuit in many important CMOS analog integrated circuits.

In the prior art, various kinds of circuits that obtain a temperature-independent reference voltage by adding a forward biased pn junction voltage to a voltage proportional to absolute temperature (T) (generally described as PTAT—Proportional To Absolute Temperature) have been devised and commercially implemented as bandgap circuits.

It is known that the forward biased pn junction voltage, if approximated by a linear equation, or in the range where it can be approximated by a linear equation, is negatively linearly dependent on absolute temperature (generally described as CTAT (Complementary To Absolute Temperature)). It is also known that by adding a (suitable) PTAT voltage to this forward biased pn junction voltage, a reference voltage substantially independent of temperature can be obtained.

Of such prior art bandgap circuits, the most standard one is illustrated in FIG. 1.

In FIG. 1, Q1 and Q2 are pnp bipolar transistors (hereinafter abbreviated pnp BJTs), R1, R2, and R3 are resistors (their values are also designated by R1, R2, and R3), AMP1 is an operational amplifier circuit, GND is a GND terminal, Vbgr is an output (reference voltage), and NODE1, IM, and IP are internal nodes. The values illustrated alongside the resistors are examples of the resistance values, and the number affixed to each BJT indicates the relative area ratio of the BJT.

The operation of the prior art circuit of FIG. 1 will be explained briefly.

It is known that, denoting the base-emitter voltage of a BJT or the forward bias voltage of a pn junction by Vbe, the relationship between the forward bias voltage of the pn junction and the absolute temperature T is roughly given by the following equation (1).

$$Vbe=Veg-aT \tag{1}$$

where Vbe is the forward bias voltage of the pn junction, Veg is the silicon bandgap voltage (about 1.2 V), "a" is the temperature dependence of Vbe (about 2 mV/° C.), and T is the absolute temperature. The value of "a" varies depending on the bias current, but it is known to be about 2 mV/° C. in the operating range.

It is also known that the relationship between the emitter current IE of the BJT and the voltage Vbe is roughly given by the following equation (2).

$$IE=IO\exp(qVbe/kT) \tag{2}$$

where IE is the emitter current of the BJT or diode current, IO is a constant (proportional to area), q is the electron charge, and k is the Boltzmann constant.

By the negative feedback action of the operational amplifier AMP1, when the voltage gain of AMP1 is sufficiently large, the potentials at the inputs IM and IP to the AMP1 become (substantially) equal and the circuit stabilizes. In this case, if the resistance ratio of R1 to R2 is, for example, chosen to be 1:10 (100 k:1M) as illustrated in FIG. 1, then the ratio of the magnitude of the current flowing through Q1 to that through Q2 is 10:1, hence the current flowing through Q1 is designated by 10I and that through Q2 by I. I×10 and I illustrated below Q1 and Q2 indicate the relationship between these currents.

If the emitter area of Q2 is 10 times the emitter area of Q1 (×1 and ×10 affixed to Q1 and Q2 in FIG. 1 indicate the relationship between these emitter areas), then denoting the base-emitter voltage of Q1 by Vbe1 and the base-emitter voltage of Q2 by Vbe2, the relations expressed the following equations (3) and (4) are obtained from the equation (2).

$$10\times I=IO\exp(qVbe1/kT) \tag{3}$$

$$I=10\times IO\exp(qVbe2/kT) \tag{4}$$

Eliminating I from the equations (3) and (4), the following equation (5) is obtained.

$$10O=\exp(qVbe1/kT-qVbe2/kT) \tag{5}$$

Here, setting Vbe1−Vbe2=ΔVbe, the following equation (6) is obtained.

$$\Delta Vbe=(kT/q)\ln(100) \tag{6}$$

As shown by the equation (6), the difference ΔVbe between the base-emitter voltages of Q1 and Q2 is expressed by the logarithm (ln(100)) of the Q1/Q2 current density ratio 100 and the thermal voltage (kT/q). In FIG. 1, IP is at Vbe1, NODE1 is at Vbe2, and IM and IP are equal; therefore, this ΔVbe represents the potential difference across the resistor R3, and the current of ΔVbe/R3 flows through the resistors R2 and R3.

Hence, the potential difference VR2 across the resistor R2 is expressed by the following equation (7).

$$VR2=\Delta VbeR2/R3 \tag{7}$$

Since the potential IM becomes equal to the potential IP, i.e., Vbe1, as described above, the potential of the reference voltage Vbgr is expressed by the following equation (8).

$$Vbgr=Vbe1+\Delta VbeR2/R3 \tag{8}$$

As shown by the equation (1), the forward bias voltage Vbe1 of the pn junction has a negative temperature dependence and decreases with increasing temperature. On the other hand, ΔVbe increases with increasing temperature as shown by the equation (6). Accordingly, by suitably selecting the constant so as to cancel the change of Vbe1 by ΔVbeR2/R3, the circuit can be designed so that the value of the reference voltage Vbgr does not depend on temperature. The value of BGROUT in that case is about 1.2 V (1200 mV), which corresponds to the silicon bandgap voltage.

In this way, by suitably selecting the circuit constant in the prior art circuit of FIG. 1, the temperature independent bandgap voltage can be generated using relatively simple circuitry.

While the prior art circuit of FIG. 1 has the advantage that the reference voltage can be generated using relatively simple circuitry as described above, it also has a shortcoming as will be described below.

FIG. 2 is a diagram for explaining the problem associated with the prior art circuit of FIG. 1. In the diagrams given hereinafter, corresponding parts are designated by the same reference characters, unless specifically stated otherwise.

In FIG. 2, IAMP1 is an ideal operational amplifier circuit, VOFF is an equivalent voltage source which represents the offset voltage of the operational amplifier, and IIM is a negative input terminal of the ideal operational amplifier IAMP1.

In FIG. 2, in order to explain the problem associated with the prior art circuit of FIG. 1, AMP1 in FIG. 1 is represented by the ideal operational amplifier IAMP1 and the equivalent offset voltage VOFF. The basic operation of the circuit of FIG. 2 is the same as that described with reference to FIG. 1, and the following describes how the offset voltage VOFF affects the output voltage Vbgr.

When forming a bandgap circuit using a CMOS circuit, especially a bandgap circuit such as illustrated in FIG. 1, the effect of the offset voltage associated with the operational amplifier is unavoidable. Ideally, when the input potentials IM and IP to AMP1 of FIG. 1 are equal, the output potential of AMP1 will become equal to (for example) about one half of the supply voltage. However, in a practical integrated circuit, the characteristics of the devices forming each amplifier are not perfectly identical. As a result, the input potentials with which the output potential of AMP1 becomes equal to (for example) about one half of the supply voltage differ for each individual amplifier, and the difference that develops between the input potentials at this time is called the offset voltage. It is known that a typical offset voltage is about ±10 mV.

To explain how the characteristics of the practical amplifier affect the output voltage of the bandgap circuit, AMP1 in FIG. 1 is represented in FIG. 2 by a combination of the ideal operational amplifier IAMP1 and the equivalent offset voltage VOFF. Here, the offset voltage of the ideal operational amplifier IAMP1 is 0 mV.

In the ideal circuit of FIG. 1, the potentials IM and IP are identical. On the other hand, in the practical circuit, since the input potentials IIM and IP to the virtual ideal operational amplifier are identical, the potentials IM and IP differ by an amount equal to the offset voltage VOFF. For simplicity, the potential difference that would develop under an ideal condition across the resistor R3 is expressed by the following equation (9).

$$VR3=\Delta Vbe \tag{9}$$

The potential difference VR3' that develops across the resistor R3 in FIG. 2 is expressed by the following rough equation (9').

$$VR3'=\Delta Vbe+VOFF \tag{9'}$$

It is to be understood here that VOFF indicates the value of the offset voltage VOFF.

The potential difference VR2' across the resistor R2 is expressed by the following equation (10).

$$VR2'=(\Delta Vbe+VOFF)R2/R3 \tag{10}$$

Hence, Vbgr is expressed by the following equation (11).

$$Vbgr=Vbe1+VOFF+(\Delta Vbe+VOFF)R2/R3 \tag{11}$$

If it is assumed that R2/R3=5 as illustrated in FIG. 2, the value of Vbgr is equal to the sum of the ideal value and the offset value multiplied by (about) 6.

In the circuit examples illustrated in FIGS. 1 and 2, in order to minimize the effect of the offset voltage of the operational amplifier, the area of Q2 is set to be 10 times that of Q1 and the current flowing through Q1 is set to be 10 times the current flowing through Q2. Accordingly, the potential difference across R3, for example, is given by the following equation (12).

$$\Delta Vbe=(kT/q)\ln(100)=26\text{ mV}\times 4.6=120\text{ mV} \tag{12}$$

As shown by the equation (12), the potential difference can be made relatively large at 120 mV. The effect of VOFF can be held relatively low in this way but, even in this case, if the bandgap voltage of 1200 mV is to be obtained by adding the PTAT voltage to the Vbe of about 600 mV, the value of the equation (12) must be multiplied by 5 and added to Vbe1. As a result, if the offset voltage VOFF is present, the effect of VOFF on Vbgr is multiplied by about (1+5)=6. (The Vbgr equation illustrated in FIG. 2 indicates this effect of the offset voltage.)

Specifically, while the circuit of FIG. 1 has the advantage that the bandgap circuit can be constructed with relatively simple circuitry, it has the limitation that the accuracy of the reference voltage Vbgr that can be achieved is limited by the offset voltage of the operational amplifier circuit.

To solve the above problem, there is proposed a so-called chopper-stabilized bandgap circuit (chopper-stabilized BGR) that switches its internal operation so as to alternately produce outputs for canceling the offset.

FIG. 3A is a diagram illustrating circuit configuration of a prior art chopper-stabilized bandgap circuit and FIG. 3B is a diagram illustrating switch signals and changes in output that occur in the circuit of FIG. 3A. The principle of operation of the prior art chopper-stabilized bandgap circuit will be described with reference to FIGS. 3A and 3B.

In FIGS. 3A and 3B, SW1, SW2, SW3, and SW4 are switches, IAMP2 is an ideal operational amplifier circuit, NODE2 and NODE3 are internal nodes, 10 is a switch signal generating circuit which generates switch signals ϕ1 and ϕ2, and 11 is an LPF (low-pass filter). The signal names ϕ1 and ϕ2 illustrated alongside the switches SW1 to SW4 indicate the periods during which the respective switches are closed; i.e. SW2 and SW3 are closed during the H (high) period of ϕ1 (hereinafter called the ϕ1 period), and SW1 and SW4 are closed during the H (high) period of ϕ2 (hereinafter called the ϕ2 period). The timing of the signals ϕ1 and ϕ2 is illustrated in FIG. 3B. The switch signal generating circuit can generate the switch signals ϕ1 and ϕ2 from a clock or can use the clock and its inverted version as the switch signals ϕ1 and ϕ2.

The operation of the prior art circuit of FIGS. 3A and 3B will be briefly described.

During the H (high) period of ϕ1 (the ϕ1 period), the circuit of FIG. 3A operates in a manner similar to the circuit of FIGS. 1 and 2. As described with reference to FIGS. 1 and 2, the offset voltage VOFF (for example) is multiplied by 6 and added to the ideal bandgap output to produce the output BGROUT. It is assumed that the value of BGROUT at this time is, for example, equal to the ideal value (1200 mV)+6×VOFF.

In the circuit of FIG. 3A, by interchanging the connections of IM and IP relative to NODE2 and NODE3 by means of the switches SW1 to SW4, BGROUT is set equal to the ideal value (1200 mV)−6×VOFF during the ϕ2 period. Specifically, in the ϕ1 period, IM and IP are connected to NODE2 and NODE3, respectively, but in the ϕ2 period, the connections are interchanged so as to connect IM to NODE3 and IP to NODE2. Further, to achieve the negative feedback by IAMP2 in the ϕ2 period as well, the circuit is configured so that the negative input of IAMP2 functions as an inverting input during the ϕ1 period and as a noninverting input during the ϕ2 period. Likewise, the circuit is configured so that the positive input of IAMP2 functions as a noninverting input during the ϕ1 period and as an inverting input during the ϕ2 period. As a result, as illustrated in FIG. 3B, the potential on the output BGROUT changes in synchronism with ϕ1 and ϕ2 so that the output voltage becomes equal to the ideal value (1200 mV)+6×VOFF during the ϕ1 period and equal to the ideal value (1200 mV)−6×VOFF during the ϕ2 period.

The potential on BGROUT changing in synchronism with ϕ1 and ϕ2 is input to the LPF (low-pass filter) 11 to extract its DC component; in this way, a reference voltage that does not contain errors caused by the offset VOFF can be obtained. Specifically, the circuit of FIG. 3A functions as a circuit that can produce an ideal reference voltage output by first converting errors caused by the offset into AC components by ϕ1 and ϕ2 and then removing the error components by the LPF.

FIG. 4 is a diagram illustrating the amplifier circuit of FIG. 3A in further detail at the transistor level. In FIG. 4, VDD is a power supply terminal, ND1, ND2, NG1, and NG2 are internal nodes, PBIAS1 is a bias potential, PM1 to PM4 are PMOS transistors, and NM1 to NM3 are NMOS transistors. Switches SW1 to SW8 operate in the same manner as in FIGS. 3A and 3B in accordance with the signal names ϕ1 and ϕ2 placed alongside them.

SW1 to SW4 operate to connect either PM2 or PM3 to IM and the other one to IP. For example, in the ϕ1 period, the gate of PM2 is connected to IM. SW5 is closed, and NM1 acts as a diode-connected load, while on the other hand, ND2 is connected to the gate NG2 of NM3. In the ϕ2 period, the gate of PM3 is connected to IM, and SW6 is closed. ND1 is connected to the gate NG2 of NM3 by SW8; in this way, a negative feedback loop is formed in the ϕ2 period as well as in the ϕ1 period. Since the positive and negative inputs of the amplifier formed by PM2, PM3, NM1, and NM2 are reversed between the ϕ1 period and the ϕ2 period, the offset voltage is equal in value but opposite in sign between the ϕ1 period and the ϕ2 period, and on the average, the circuit operates as an amplifier free from offset.

In the prior art, errors caused by the offset voltage of the operational amplifier have been reduced by the chopper-stabilized bandgap circuit (chopper-stabilized BGR) such as illustrated in FIGS. 3 and 4.

RELATED DOCUMENTS

Japanese Laid-open Patent Publication No. 2007-299294
Japanese Laid-open Patent Publication No. H06-244656
Japanese Laid-open Patent Publication No. 2004-80581
Japanese Patent No. 3273786
U.S. Pat. No. 6,462,612
M. C. Weng et. al., "Low Cost CMOS On-Chip and Remote Temperature Sensors," IEICE Transactions on Electronics, Vol. E84-C, No. 4, pp. 451-459, April 2001 (Language: English)
Y. S. Shyu et al., "A 0.99 μA Operating Current Li-Ion Battery Protection IC," IEICE Transactions on Electronics, Vol. E85-C, No. 5, pp. 1211-1215, May 2002 (Language: English)

SUMMARY

According to an aspect of the embodiments, a constant-voltage generating circuit includes: a reference potential generating unit which outputs a prescribed first potential that varies with a positive or negative temperature dependence in accordance with a potential on an output line, and a second potential that varies with an opposite temperature dependence to the positive or negative temperature dependence with respect to the potential on the output line; a first amplifier unit which takes the first potential and the second potential as two inputs, and whose output is connected to the output line during a first operation period; a second amplifier unit which takes the first potential and the second potential as two inputs, and whose output is connected to the output line during a second operation period; and a low-pass filter connected to the output line, and wherein the first operation period and the second operation period are repeated, one alternating with the other, the first amplifier unit stores offset voltage of the first amplifier unit during the second operation period, and produces an output, during the first operation period, that brings the first potential and the second potential equal to each other by canceling out the offset voltage using the stored offset voltage, and the second amplifier unit stores offset voltage of the second amplifier unit during the first operation period, and produces an output, during the second operation period, that brings the first potential and the second potential equal to each other by canceling out the offset voltage using the stored offset voltage.

The object and advantages of the embodiments will be realized and attained by means of the elements and combination particularly pointed out in the claims.

It is to be understood that both the foregoing general description and the following detailed description are exemplary and explanatory, and are not restrictive of the invention as claimed.

DESCRIPTION OF EMBODIMENTS

As described previously, it has been known in the prior art to provide a BGR circuit utilizing a chopper circuit to eliminate errors caused by operational amplifier offset voltage.

However, in the prior art chopper-stabilized BGR circuit, since errors caused by operational amplifier offset voltage are first converted into AC components and then the AC components are removed by an LPF (low-pass filter), an LPF having a large time constant has to be provided in order to reduce the ripple in the output voltage. That is, since the LPF is constructed using a capacitor C and a resistor R, there has been the problem that the values of C and R both increase and, if the offset voltage is estimated with a large margin, the area that the LPF occupies increases.

The offset voltage has a certain range of distribution, and it is not easy to predict its maximum value, hence the necessity to estimate the offset voltage with a sufficient margin; for this reason, the LPF has been designed larger than necessary.

Preferred embodiments will be explained with reference to accompanying drawings.

Figure 5A:
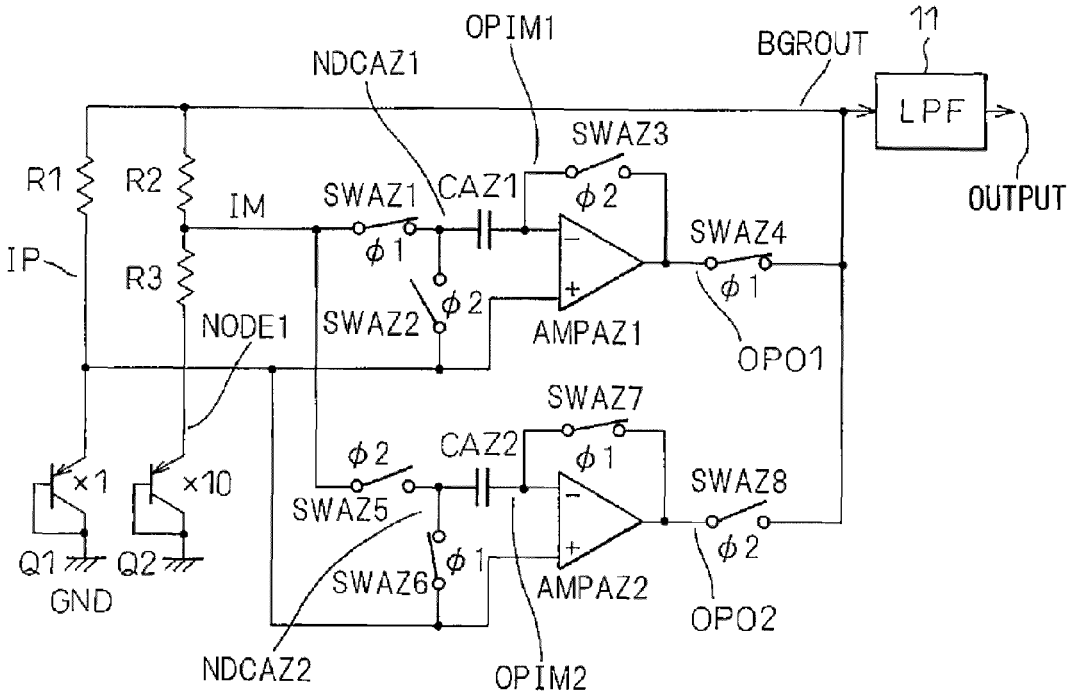
FIGS. 5A and 5B are diagrams illustrating the circuit configuration and operating signals of a constant-voltage generating circuit according to a first embodiment that utilizes a bandgap circuit (BGR circuit)
Figure 5A:
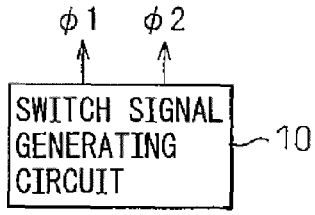
Figure 5B:
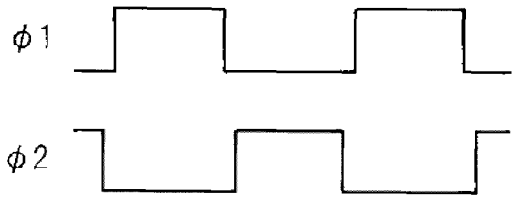
Figure 6:
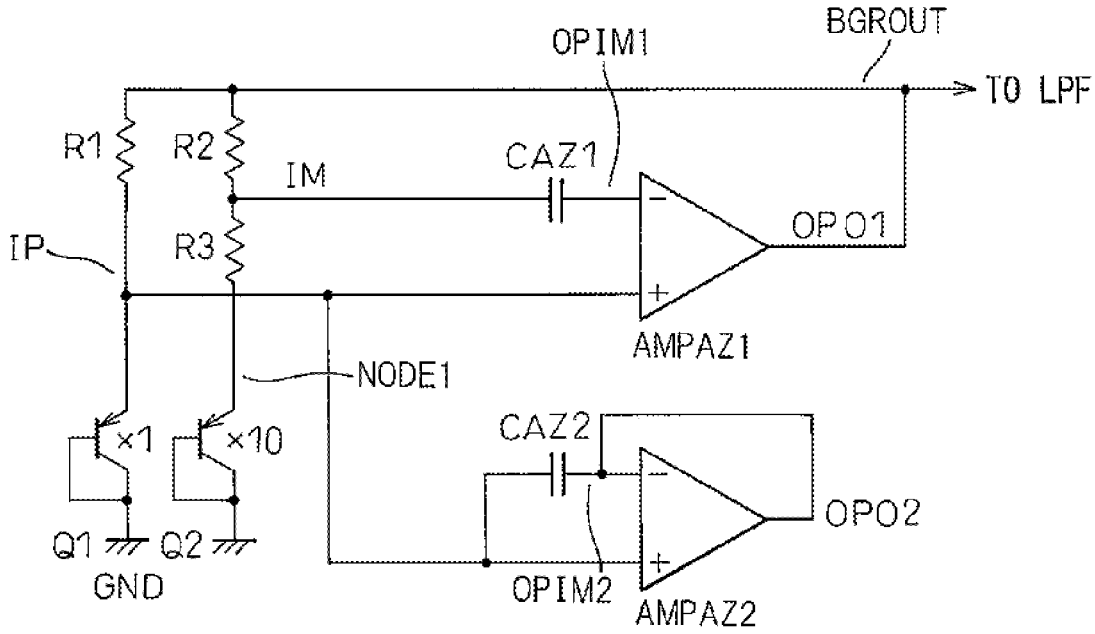
FIG. 6 is a diagram for explaining the operation of the constant-voltage generating circuit of the first embodiment.
Figure 7:
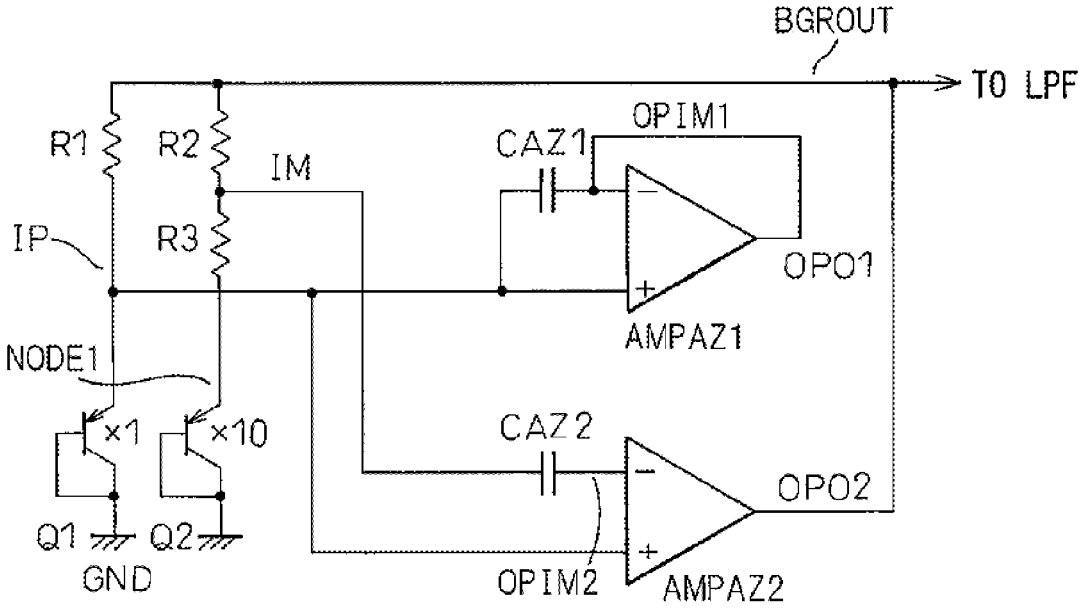
FIG. 7 is a diagram for explaining the operation of the constant-voltage generating circuit of the first embodiment.

FIG. 5A is a diagram illustrating the basic circuit configuration of a constant-voltage generating circuit according to a first embodiment and FIG. 5B is a diagram illustrating switch signals used in the circuit. FIGS. 6 and 7 each illustrate an equivalent circuit representing the circuit of FIG. 5A at a given time for explaining the operation of the circuit of FIG. 5A. The constant-voltage generating circuit of the first embodiment also is a bandgap circuit.

As illustrated in FIG. 5A, the constant-voltage generating circuit of the first embodiment includes an output signal line to which an output signal BGROUT is applied (the output line itself may hereinafter be sometimes referred to as BGROUT), a resistor R1 and a pnp bipolar transistor (BJT) Q1 connected in series between the output signal line and a GND terminal, resistors R2 and R3 and a pnp bipolar transistor (BJT) Q2 connected in series between the output signal line and the GND terminal, first and second amplifier units to which a connection node IP between R1 and Q1 and a connection node IM between R2 and R3 are coupled as inputs, a switch signal generating circuit 10 which generates the switch signals $\phi$1 and $\phi$2, and a low-pass filter (LPF) 11 to which the output signal BGROUT is input.

The first amplifier unit includes a first CMOS operational amplifier AMPAZ1 whose positive input is connected to IP, a first switch SWAZ1 connected between IM and an internal node NDCAZ1, a second switch SWAZ2 connected between IP and NDCAZ1, a capacitor CAZ1 connected between NDCAZ1 and the negative input (internal node OPIM1) of AMPAZ1, a third switch SWAZ3 connected between OPIM1 and the output (OPO1) of AMPAZ1, and a fourth switch SWAZ4 connected between OPO1 and the output signal line.

The second amplifier unit includes a second CMOS operational amplifier AMPAZ2 whose positive input is connected to IP, a fifth switch SWAZ5 connected between IM and an internal node NDCAZ2, a sixth switch SWAZ6 connected between IP and NDCAZ2, a capacitor CAZ2 connected between NDCAZ2 and the negative input (internal node OPIM2) of AMPAZ2, a seventh switch SWAZ1 connected between OPIM2 and the output (OPO2) of AMPAZ2, and an eighth switch SWAZ8 connected between OPO2 and the output signal line. In other words, the first amplifier unit and the second amplifier unit are identical in configuration.

The numbers affixed to Q1 and Q2 each indicate an example of the relative area ratio of the BJT. The signal names $\phi$1 and $\phi$2 illustrated alongside the switches SWAZ1 to SWAZ8 indicate the periods during which the respective switches are closed, the convention being that when the corresponding signal is H (high), the switch is closed and, when the corresponding signal is L (low), the switch is open. The switch signals $\phi$1 and $\phi$2 are similar in timing, for example, to the signals $\phi$1 and $\phi$2 illustrated in FIG. 3B.

The operation of the reference voltage generating unit comprising Q1 and Q2 and resistors R1, R2, and R3 has already been described, and the description will not be repeated here.

Figure 3A:
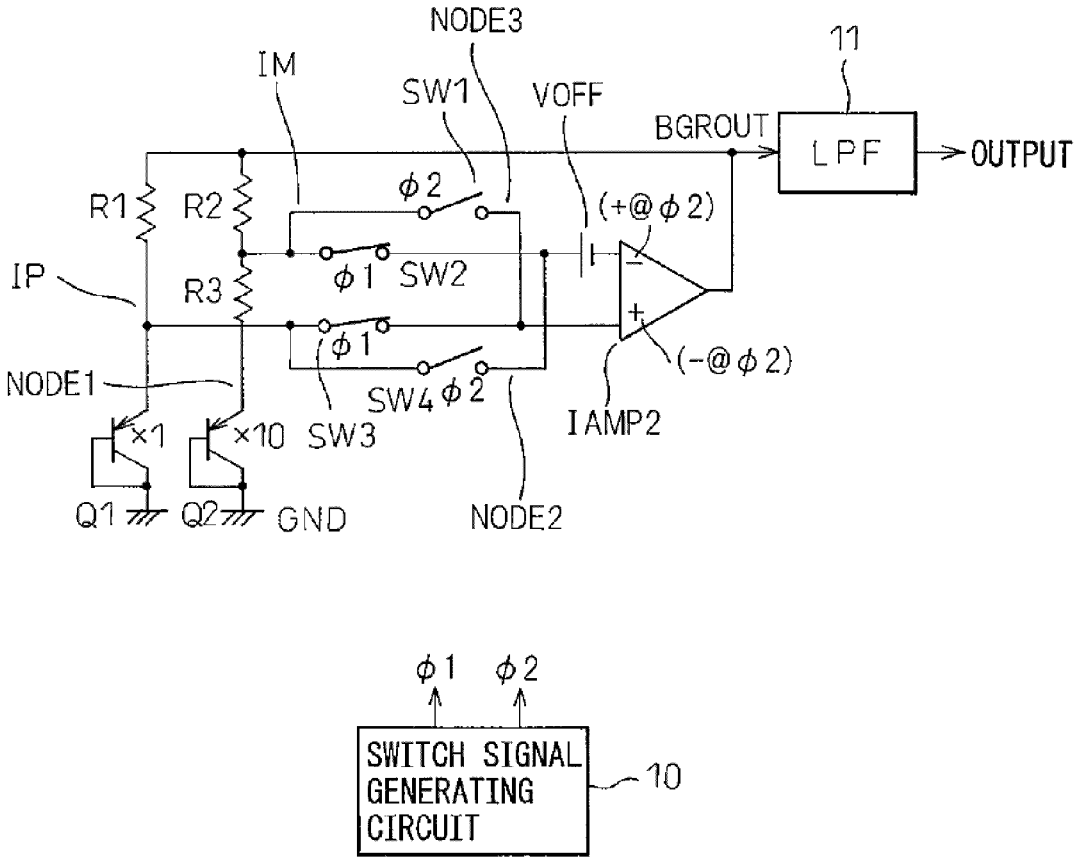
FIGS. 3A and 3B are diagrams illustrating the circuit configuration and operating signals of a prior art chopper-stabilized bandgap circuit (BGR circuit)
Figure 3B:
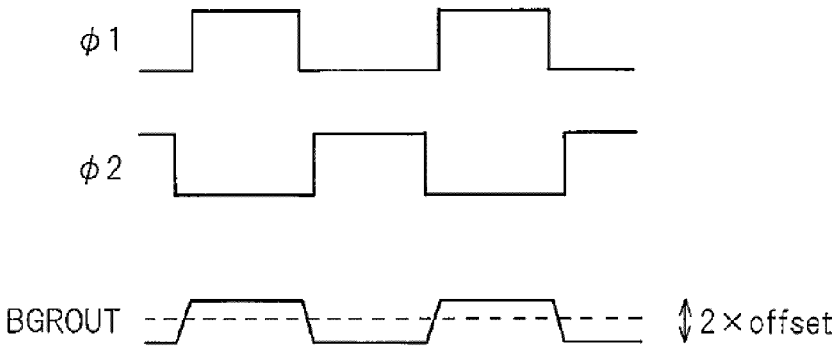
Figure 4:
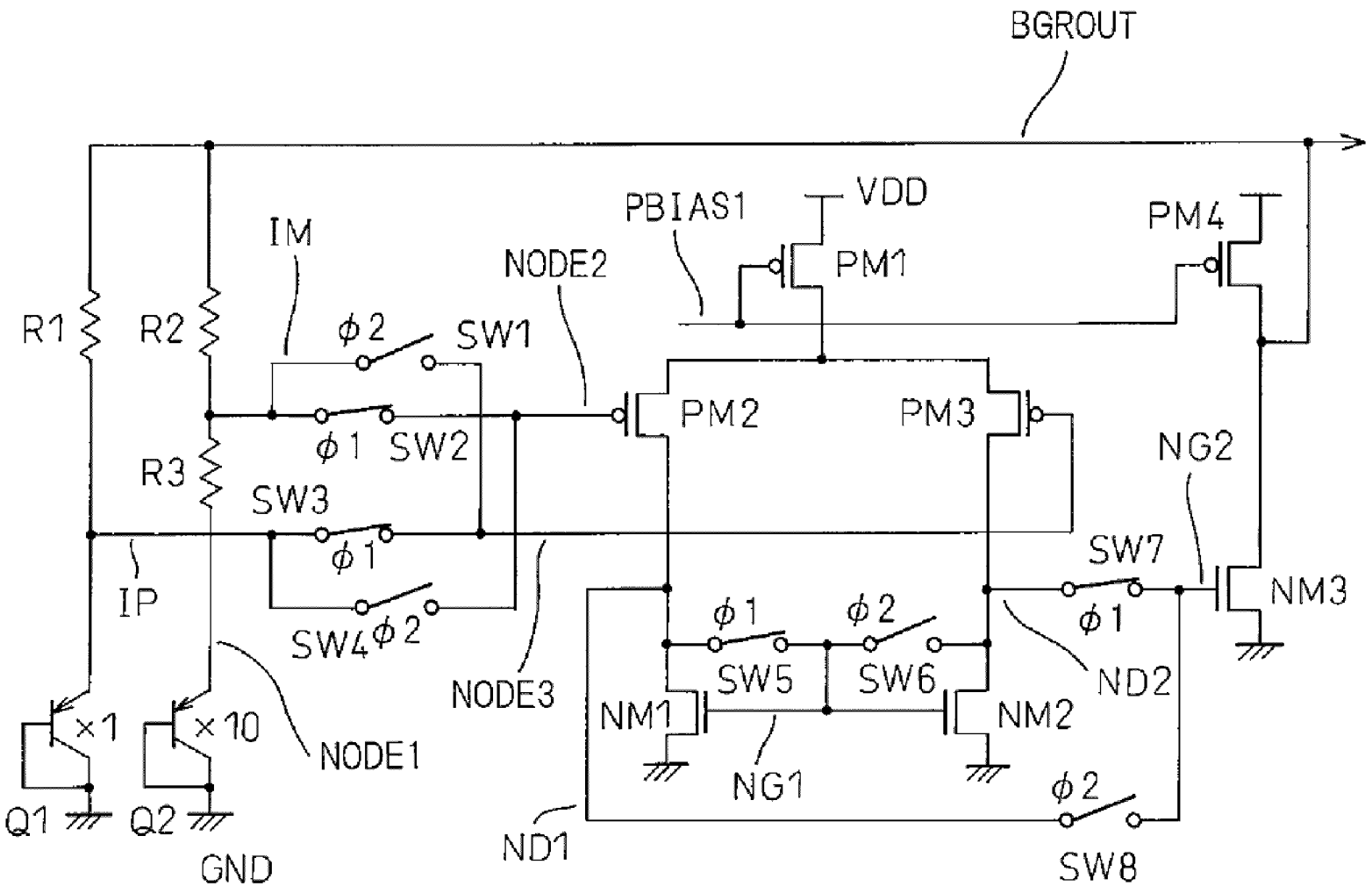
FIG. 4 is a diagram illustrating a circuit example of the prior art chopper-stabilized bandgap circuit (BGR circuit)

In the prior art circuit of FIGS. 3 and 4, the inputs to the CMOS amplifier are reversed periodically and, using this periodic frequency as the basic frequency, the offset voltage is converted into an AC signal, and error components are removed by the LPF to produce an ideal bandgap output voltage.

By contrast, in the circuit of the first embodiment illustrated in FIG. 5A, the offset voltages of the CMOS amplifiers are stored in the respective capacitors CAZ1 and CAZ2, and the circuit is operated in such a manner that the offset voltage of each amplifier is canceled using the voltage stored in the corresponding capacitor, thereby achieving an ideal amplifier where the offset voltage as a whole is substantially reduced to zero.

In the H (high) period of $\phi$1 (hereinafter called the $\phi$1 period), the circuit of FIG. 5A becomes equivalent to the circuit illustrated in FIG. 6. During the $\phi$1 period, $\phi$2 remains L (low). Similarly, in the H (high) period of $\phi$2 (hereinafter called the ϕ2 period), the circuit of FIG. 5A becomes equivalent to the circuit illustrated in FIG. 7. During the ϕ2 period, ϕ1 remains L. In FIGS. 6 and 7, the circuit of FIG. 5A is illustrated in simplified form to clarify the circuit operation.

During the ϕ1 period, the switches SWAZ1 and SWAZ4 in FIG. 5A are closed (ON). On the other hand, SWAZ2 and SWAZ3 are open (OFF). As a result, as illustrated in FIG. 6, the output OPO1 of the amplifier AMPAZ1 is at the same potential as BGROUT. At this time, the negative input OPIM1 of AMPAZ1 is coupled only to the capacitor CAZ1. At the same time, during the ϕ1 period, the switches SWAZ6 and SWAZ1 in FIG. 5A are ON, while SWAZ5 and SWAZ8 are OFF. FIG. 6 illustrates this condition.

The output of the CMOS amplifier AMPAZ2 is connected to the negative input OPIM2 of AMPAZ2 via SWAZ1. Here, since SWAZ8 is OFF, the output OPO2 of AMPAZ2 is disconnected from BGROUT. Further, since SWAZ5 is OFF, the potential at the one node NDCAZ2 of the capacitor CAZ2 is the same as the emitter potential IP of Q1, which, at the same time, provides the positive input potential to AMPAZ2.

Specifically, during the ϕ1 period, the positive input of the CMOS amplifier AMPAZ2 is at the same potential as IP, and the negative input is at the same potential as the output OPO2 of AMPAZ2. When the voltage gain of the CMOS amplifier AMPAZ2 is sufficiently large, and when its input-referred offset voltage is such that the potential at the negative input is larger than the potential at the positive input by VOFF, the output potential OPO2 will become equal to about one half of the supply voltage.

The connection of AMPAZ2 in FIG. 6 is a connection well known as a voltage follower. Since the positive input of AMPAZ2 is at the same potential as IP, the output potential OPO2 does not become equal to about one half of the supply voltage unless the potential at the negative input of AMPAZ2 is brought approximately equal to IP+VOFF.

The connection of AMPAZ2 in FIG. 6 forms a negative feedback circuit such that when the potential at OPIM2 rises, the potential at OPO2 falls and, when the potential at OPIM2 falls, the potential at OPO2 rises, causing the potential at OPIM2 to rise. Accordingly, when the voltage gain of the CMOS amplifier AMPAZ2 is sufficiently large, the potential at OPIM2 is brought approximately equal to IP+VOFF and stabilizes.

More specifically, while the positive input of AMPAZ2 is held at the same potential as IP, the potential at OPIM2 is brought approximately equal to the sum of the potential IP and the offset voltage VOFF, so that the potentials at both ends of the capacitor CAZ2 are IP and IP+VOFF, respectively. In this way, CAZ2 stores an electric charge such that the potential at OPIM2 is brought equal to the sum of the positive input potential IP and the offset voltage VOFF when the same potential as the positive input IP is applied to NDCAZ2. In other words, the potential difference across CAZ2 is approximately equal to VOFF. The following describes how the BGR circuit is operated by canceling the offset voltage of AMPAZ2 using the electric charge stored on CAZ2.

A description will be given of the operation of the circuit of the embodiment when switching is made from the ϕ1 period to the ϕ2 period as ϕ2 goes H. During the ϕ2 period, ϕ1 remains L (low).

During the ϕ2 period, SWAZ1 and SWAZ4 in FIG. 5A are OFF, and SWAZ2 and SWAZ3 are ON. On the other hand, SWAZ5 and SWAZ8 are ON, and SWAZ6 and SWAZ7 are OFF.

As described earlier, in the ϕ2 period, the circuit of FIG. 5A becomes equivalent to the circuit illustrated in FIG. 7. Since SWAZ8 is ON, the output OPO2 of AMPAZ2 is at the same potential as BGROUT. Since SWAZ6 is OFF and SWAZ5 is ON, one end NDCAZ2 of CAZ2 is connected to IM. Since SWAZ7 is OFF, only CAZ2 is coupled to OPIM2. Further, during the ϕ1 period preceding the ϕ2 period, the offset voltage VOFF has been stored in CAZ2.

As described with reference to FIG. 6, the electric charge stored on CAZ2 is such that when the potential at one end of CAZ2, that is, the potential at NDCAZ2 in FIG. 5A, becomes equal to the potential at the positive input IP of AMPAZ2, the potential at the negative input OPIM2 of AMPAZ2 is brought equal to the sum of the positive input potential IP and the offset voltage VOFF. FIG. 6 has been described by assuming that VOFF is, for example, a positive value, but if the sign of VOFF is negative, the circuit operation of FIG. 6 is not affected; after all, a charge such that the potential difference between OPIM2 and the positive input of AMPAZ2 becomes equal to the offset voltage is stored on CAZ2, and thus the potential difference across CAZ2 is equal to the offset voltage. When the potential at NDCAZ2 in FIG. 5A becomes equal to the potential at the positive input IP of AMPAZ2, the potential at the negative input OPIM2 of AMPAZ2 is brought equal to the sum of the positive input potential IP and the offset voltage VOFF.

As a result, CAZ2 and AMPAZ2 in FIG. 7 together operate as a circuit substantially equivalent to an ideal amplifier in which the offset voltage as seen from IM and IP becomes approximately equal to zero. The reason is that the feedback operation of the bandgap circuit stabilizes with the potential at OPIM2 brought approximately equal to IP+VOFF and with IM held at the same potential as IP. If the potential IM is approximately equal to IP, the potential at OPIM2 is equal to IP+VOFF.

The output potential OPO2 of AMPAZ2 itself does not become equal to about one half of the supply voltage unless the potential OPIM2 is brought higher than the positive input potential IP by an amount equal to the offset voltage VOFF, but since the potential difference across CAZ2 is VOFF, IM and IP are at substantially the same potential, which satisfies the condition that brings the potential at OPIM2 to IP+VOFF, and the bandgap circuit of FIG. 7 thus stabilizes.

Specifically, by storing the offset voltage of AMPAZ2 in CAZ2 during the ϕ1 period, the offset voltage as seen from IM and IP can be reduced to nearly zero during the ϕ2 period, and thus the potential on BGROUT can be brought approximately equal to the ideal value described in connection with the prior art circuit. In practice, since the voltage gain of AMPAZ2 is not infinite but finite, the offset voltage stored in CAZ2 is not perfectly identical with that of AMPAZ2, but the difference is very small.

The operation of AMPAZ1 during the ϕ2 period will be described. Since SWAZ4 is OFF, the output OPO1 of AMPAZ1 is disconnected from BGROUT. Since SWAZ3 is ON, the negative input OPIM1 of AMPAZ1 is at the same potential as the output OPO1 of AMPAZ1. Since SWAZ1 is OFF and SWAZ2 is ON, the positive input of AMPAZ1 is at the same potential as IP, and the switch-side node NDCAZ1 of CAZ1 is also at the same potential as IP. It has been described with reference to FIG. 6 that the offset voltage of AMPAZ2 is stored in CAZ2, but in the case of AMPAZ1, exactly the same operation is performed during the ϕ2 period.

More specifically, during the ϕ1 period, an electric charge corresponding to the offset voltage of AMPAZ2 is stored on CAZ2, and the potential difference across CAZ2 becomes equal to the offset voltage of AMPAZ2. Likewise, during the ϕ2 period, an electric charge corresponding to the offset voltage of AMPAZ1 is stored on CAZ1, and the potential difference across CAZ1 becomes equal to the offset voltage of AMPAZ1.

During the ϕ1 period, the offset voltage of AMPAZ2 is stored in CAZ2, and during the ϕ2 period, the bandgap voltage BGROUT is generated using AMPAZ2 and CAZ2. During the ϕ2 period, the offset voltage of AMPAZ1 is stored in CAZ1, and during the ϕ1 period, the bandgap voltage BGROUT is generated using AMPAZ1 and CAZ1. With the ϕ1 period alternating with the ϕ2 period, BGROUT can always be generated using the amplifier in which the offset voltage is canceled out.

In this way, in the circuit of the first embodiment, BGROUT is not output by converting errors associated with the offset voltage into AC components as in the case of the prior art circuit of FIGS. 3 and 4. However, a transition glitch occurs on BGROUT during transition from the ϕ1 period to the ϕ2 period. To remove this glitch, the potential on BGROUT is input to the LPF and smoothed out to produce the bandgap voltage of the ideal value.

The basic operation and concept of the constant-voltage generating circuit (bandgap circuit–BGR circuit) according to the first embodiment has been described above with reference to FIGS. 5 to 7.

Figure 8:
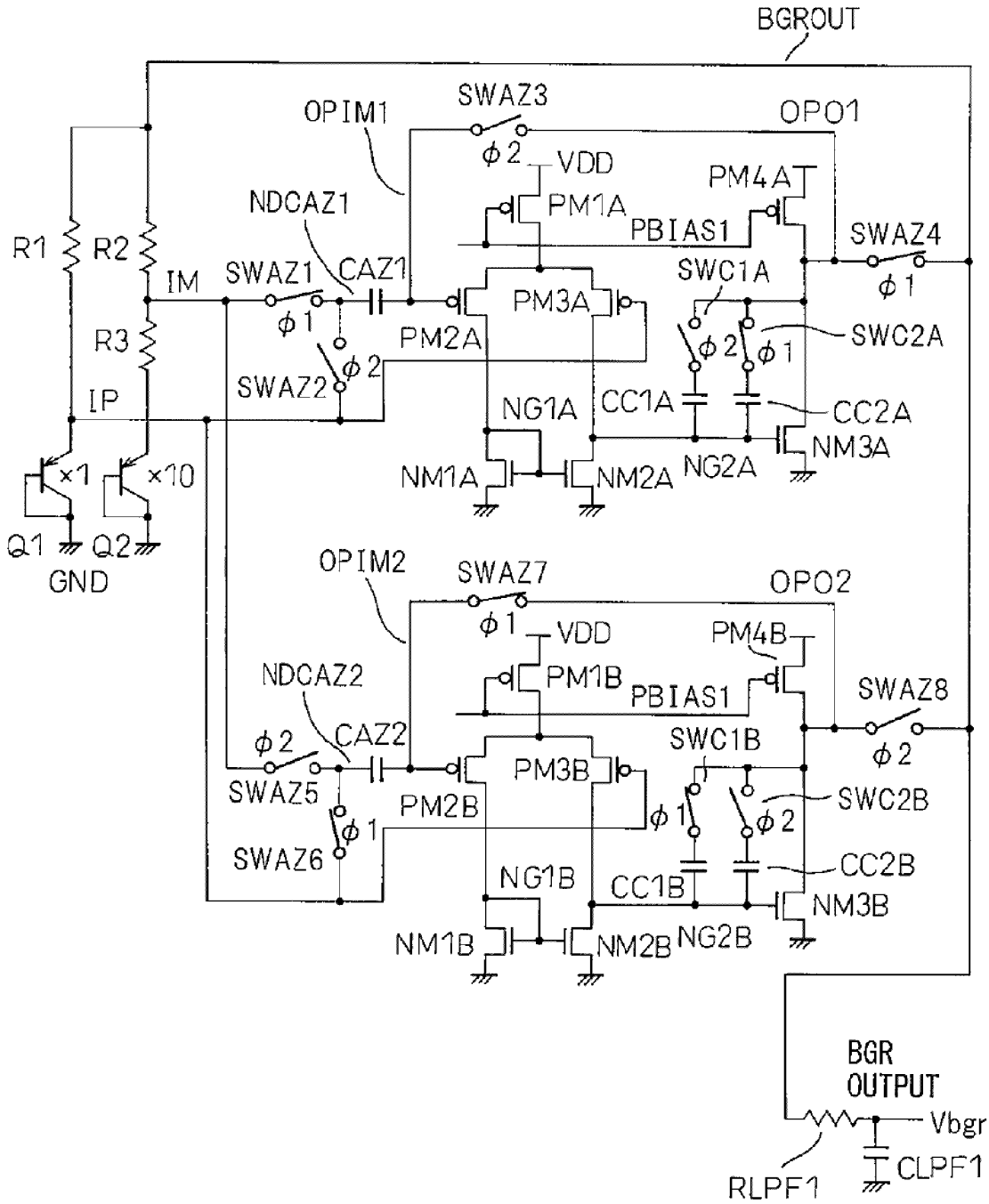
FIG. 8 is a diagram illustrating the circuit configuration of the constant-voltage generating circuit of the first embodiment in further detail.

FIG. 8 is a diagram illustrating the configuration of the BGR circuit according to the first embodiment of FIG. 5A in further detail at the transistor level, especially the configuration of the first and second operational amplifiers AMPAZ1 and AMPAZ2 and the LPF 11. The BGR circuit of the first embodiment can be implemented using, for example, the configuration illustrated in FIG. 8.

As illustrated in FIG. 8, the first operational amplifier AMPAZ1 includes PMOS transistors PM1A, PM2A, PM3A, and PM4A, NMOS transistors NM1A, NM2A, and NM3A, two capacitors CC1A and CC2A, and two switches SWC1A and SWC2A. Likewise, the second operational amplifier AMPAZ2 includes PMOS transistors PM1B, PM2B, PM3B, and PM4B, NMOS transistors NM1B, NM2B, and NM3B, two capacitors CC1B and CC2B, and two switches SWC1B and SWC2B. As illustrated, the first and second operational amplifier AMPAZ1 and AMPAZ2 are identical in configuration. The LPF 11 includes a resistor RLPF1 and a capacitor CLPF1. PBIAS1 indicates the bias voltage externally applied to each operational amplifier. NG1A, NG2A, NG1B, and NG2B are internal nodes. In the following description, device names beginning with R indicate resistors, device names beginning with PM indicate PMOS transistors, device names beginning with NM indicate NMOS transistors, device names beginning with C indicate capacitors, and device names beginning with SW indicate switches, unless specifically stated otherwise.

The portions of AMPAZ1 and AMPAZ2 described by transistors are by themselves conventional CMOS amplifier circuits, and will not be further described herein.

The circuit of FIG. 8 differs from conventional CMOS amplifiers by the inclusion of the phase compensation capacitors CC1A, CC2A, CC1B, and CC2B and the switches SWC1A, SWC2A, SWC1B, and SWC2B for connecting the respective capacitors. The phase compensation capacitors will be described below.

As previously described with reference to FIG. 5A, AMPAZ1 and AMPAZ2 alternately perform the offset storing operation (hereinafter also called the auto-zero operation) and the BGR feedback amplifier operation in such a manner that during the period when one amplifier is storing the offset, the other amplifier functions as a BGR feedback amplifier and outputs the bandgap voltage on BGROUT.

The purpose of the CMOS amplifier when using it as a feedback amplifier in the BGR circuit is to control the potential on BGROUT through feedback so that the potentials IP and IM in FIG. 8 become identical with each other. Therefore, when storing the offset by the auto-zero operation, the gate input of PM3A is coupled to IP.

If the input potential is different, the offset voltage can also be different; therefore, the offset voltage for the potential finally input to the amplifier must be stored in CAZ1 or CAZ2, and hence the circuit configuration of FIGS. 5 and 8.

The output potential OPO1 of AMPAZ1, for example, when it is used as a BGR feedback amplifier is 1.2 V. On the other hand, during the auto-zero period, the output potential OPO1 of AMPAZ1 is about 0.6 V which is approximately equal to the potential IP. Further, during the auto-zero period as well as the BGR feedback amplifier period, AMPAZ1 forms a negative feedback circuit, and hence phase compensation becomes necessary. Generally, since phase compensation ensures the stable operation of the feedback circuit by creating a dominant pole using a mirror capacitor, the bandwidth becomes smaller than when phase compensation is not applied. The problem here is that the potential at the output OPO1 of AMPAZ1 must be changed between the auto-zero period and the BGR feedback amplifier period but it is difficult to change the potential at high speed.

To solve the above problem and to ensure the stable operation of the feedback circuit, two separate phase compensation capacitors CC1A and CC2A are provided in the circuit of FIG. 8, one for use in the auto-zero period and the other for use in the BGR feedback amplifier period. For example, in the case of AMPAZ1, the offset voltage is stored in CAZ1 during the ϕ2 period. During this time, the potential at OPO1 is about 0.6 V, SWC1A is ON, and CC1A functions as the phase compensation capacitor.

In the ϕ1 period, AMPAZ1 is operated as a BGR feedback amplifier, and the potential at OPO1 is 1.2 V. During this time, SWC2A is ON (SWC1A is OFF), and CC2A functions as the phase compensation capacitor. In this way, by providing the separate phase compensation capacitors for the ϕ1 and ϕ2 periods, respectively, and using them by switching from one to the other, it becomes possible to eliminate the need to charge and discharge the respective mirror capacitors CC1A and CC2A in order to cause the potential at OPO1 to change. As a result, the time required to change the potential at OPO1 from 0.6 V to 1.2 V and from 1.2 V to 0.6 V can be shortened.

At the end of the ϕ1 period, SWC2A is turned off, so that the potential difference between NG2A and OPO1 during the ϕ1 period is stored and held in CC2A. Similarly, at the end of the ϕ2 period, SWC1A is turned off, so that the potential difference between NG2A and OPO1 during the ϕ2 period is stored and held in CC1A. By switching from one capacitor to the other in this manner, potential variations associated with the charging and discharging of the respective mirror capacitors CC1A and CC2A can be minimized.

The effect that can be achieved by providing CC1A and CC2A has been described above for the case of AMPAZ1, but it will be appreciated that the same applies for the case of AMPAZ2. By providing the separate phase compensation capacitors, one for use in the auto-zero period and the other for use in the BGR feedback amplifier period, and using them by switching from one to the other, as described above, there is offered the effect of being able to shorten the time required to change the amplifier output potential. As a result, the period during which the potential on BGROUT varies can be shortened, and the range of variation of the voltage Vbgr can be reduced even if the size of the LPF (RLPF1, CLPF1) is reduced.

Figure 1:
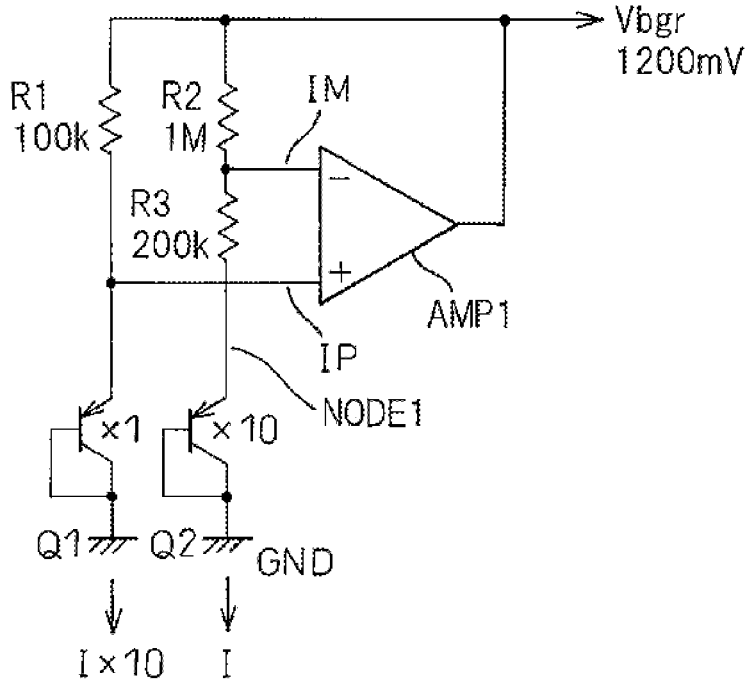
FIG. 1 is a diagram illustrating a circuit example of a prior art bandgap circuit (BGR circuit)
Figure 9:
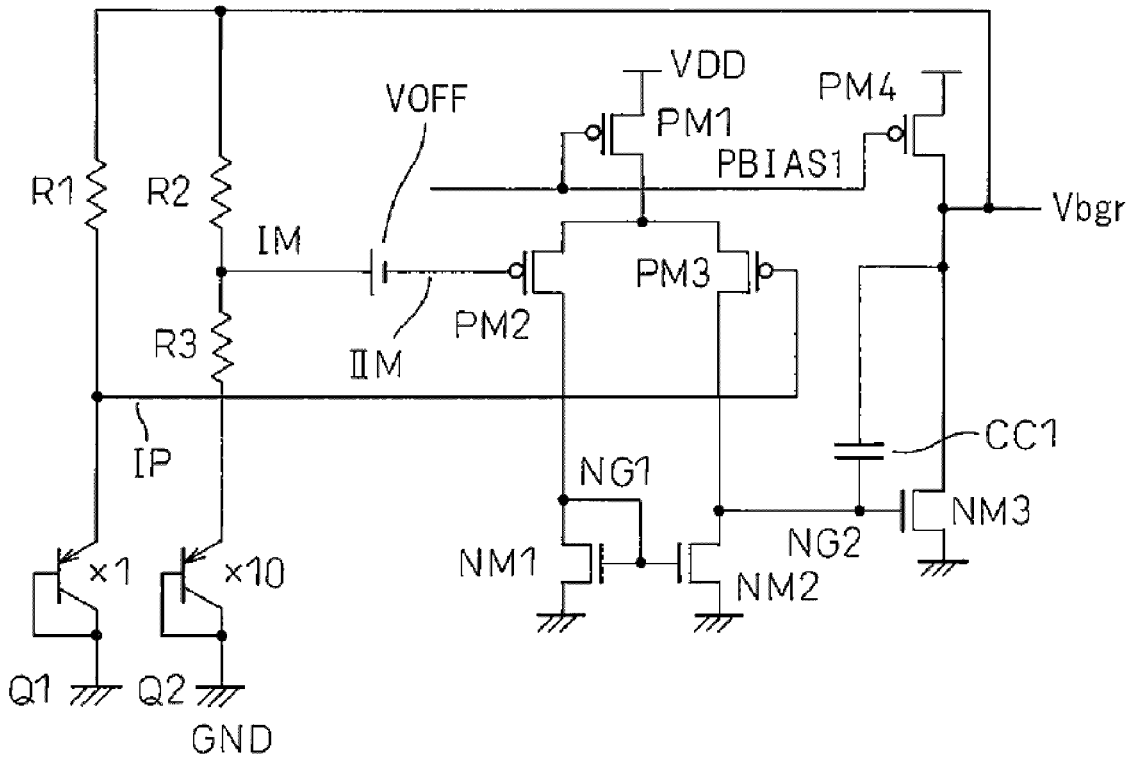
FIG. 9 is a diagram for explaining the relationship between temperature, output voltage, and offset voltage in the prior art bandgap circuit (BGR circuit)

FIG. 9 is provided to obtain the relationship between the output voltage Vbgr, temperature, and offset voltage in the prior art circuit of FIG. 1 in order to demonstrate the effect of the circuit of the first embodiment illustrated in FIGS. 5 and 8. The circuit of FIG. 9 represents the prior art circuit of FIGS. 1 and 2 at the transistor level, and the offset voltage of the amplifier is designated by VOFF. It is assumed that the (random) offset voltage of the amplifier constructed from the transistors (PM2, PM3, NM1, NM2, etc.) is zero, and the actual amplifier offset voltage is represented by VOFF.

Figure 2:
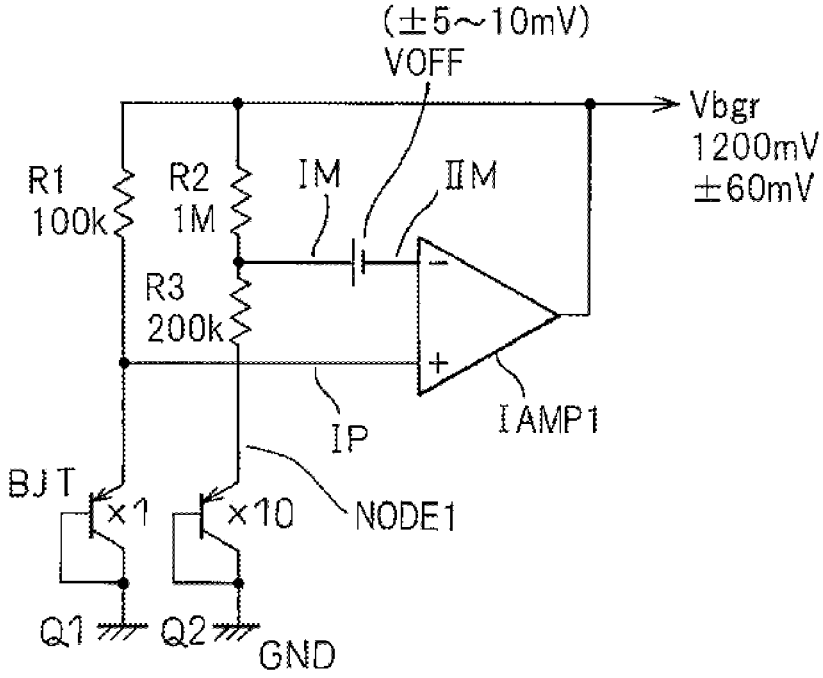
FIG. 2 is a diagram for explaining the relationship between offset voltage and output voltage in the prior art bandgap circuit (BGR circuit)

The circuit of FIG. 9 illustrates the amplifier in the circuit diagram of FIG. 2 at the transistor level, and CC1 functions as the phase compensation capacitor. The configuration of the CMOS amplifier in FIG. 9 is in itself the same as that in the circuit in FIG. 8, and the real amplifier is represented by the ideal amplifier, formed by PM1 to PM4 and NM1 to NM3, and the offset voltage VOFF. In other respects, the operation is the same as the operation so far described up to FIG. 8, and therefore the description will not be repeated here.

Figure 10:
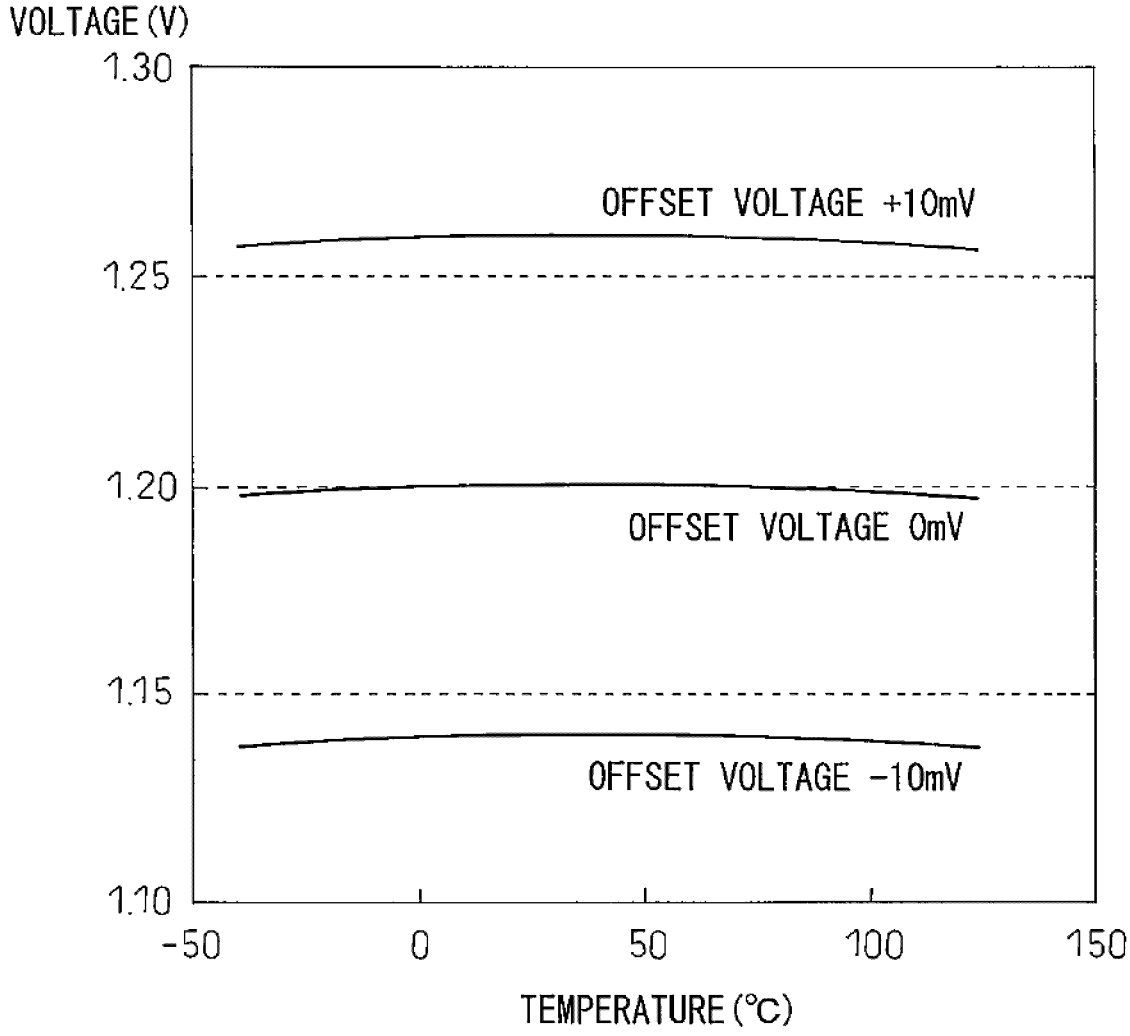
FIG. 10 is a diagram illustrating one example of the relationship between temperature, output voltage, and offset voltage in the prior art bandgap circuit (BGR circuit)

FIG. 10 illustrates the relationship between the bandgap voltage Vbgr, temperature, and offset voltage VOFF in the prior art circuit of FIG. 9. In FIG. 10, the ordinate represents the voltage Vbgr of the circuit of FIG. 9, and the abscissa the temperature. Using the offset voltage as a parameter, the relationship is illustrated for the case of VOFF being 10 mV, 0 mV, and −10 mV, respectively. As previously noted in the description of the prior art circuit, the output voltage Vbgr of the circuit of FIG. 9 greatly varies depending on the offset voltage. In the ideal condition in which the offset voltage is zero, the voltage Vbgr is constant at about 1.2 V despite variations in temperature, but when the offset voltage is +10 mV, Vbgr increases, and conversely, when the offset voltage is −10 mV, Vbgr decreases. In FIG. 9, the offset voltage is provided by the ideal voltage source VOFF, and the relationship between VOFF and Vbgr is illustrated in FIG. 10, but since the offset voltage itself can vary depending on the temperature, in practice the relationship between the output voltage and the temperature is more complicated than that illustrated in FIG. 10, and it can therefore be seen that voltage accuracy is difficult to achieve.

Figure 11:
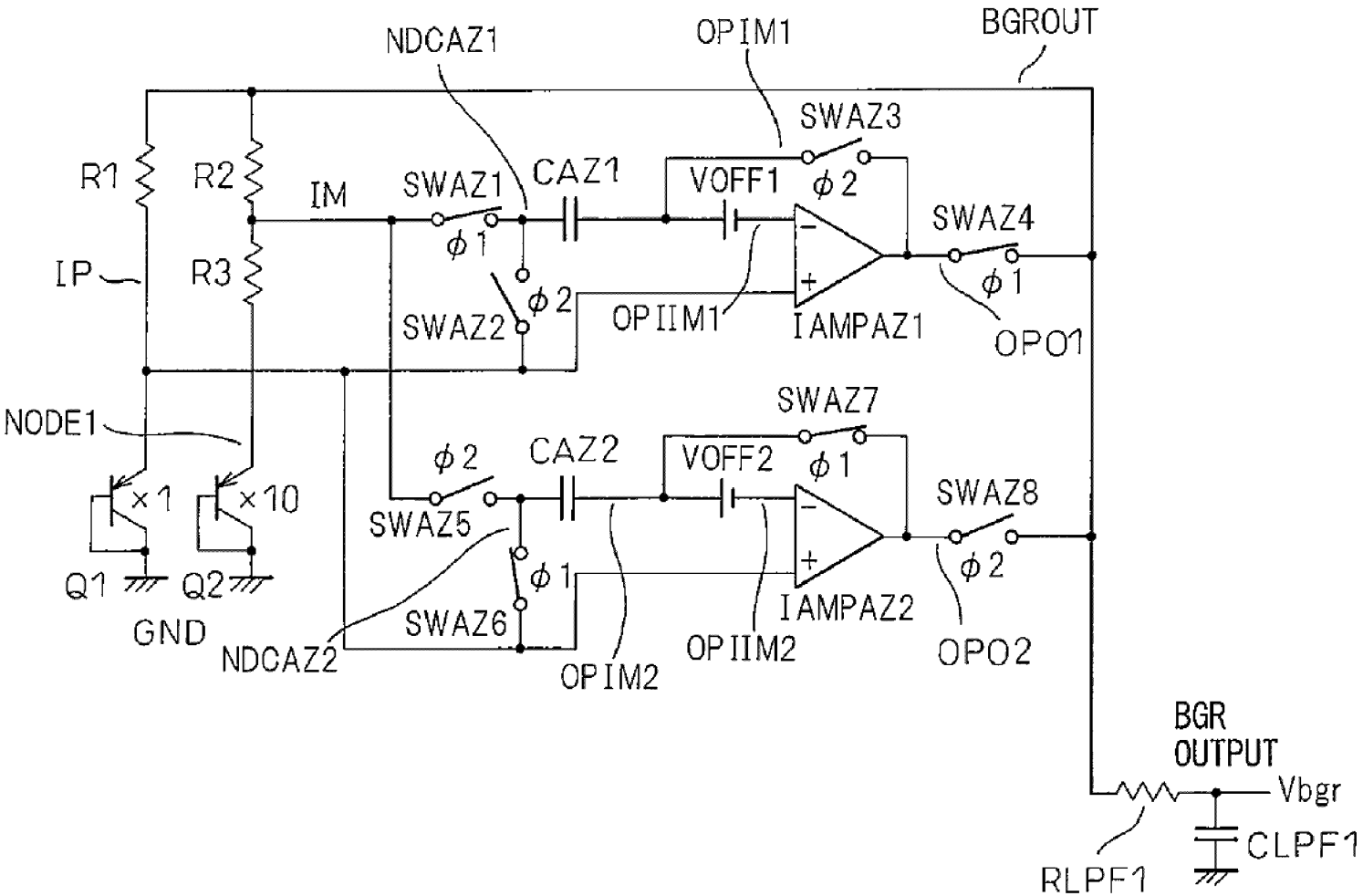
FIG. 11 is a diagram for explaining the relationship between temperature, output voltage, and offset voltage in the constant-voltage generating circuit (BGR circuit) of the first embodiment.

FIG. 11 is a circuit diagram provided to obtain the relationship between the output voltage Vbgr, temperature, and offset voltage in the circuit of the first embodiment illustrated in FIGS. 5 and 8. In FIG. 11, AMPAZ1 and AMPAZ2 are each represented by a combination of the ideal amplifier IAMPAZ1 or IAMPAZ2 and the offset voltage VOFF1 or VOFF2. The detailed circuit configuration of IAMPAZ1 and IAMPAZ2 is the same as that illustrated in FIG. 8. The effect of the circuit of FIG. 8 will be described by obtaining Vbgr when VOFF1 and VOFF2 are zero and when they are not.

Since the offset voltages are represented by VOFF1 and VOFF2, the negative inputs of the ideal amplifiers IAMPAZ1 and IAMPAZ2 are designated by OPIIM1 and OPIIM2, respectively. The circuit operation itself is the same as that of the circuit of FIGS. 5 and 8, and will not be described in detail here, and examples of the operating waveforms of the circuit of FIG. 11 will be described below with reference to FIGS. 12A to 12D and subsequent figures.

Figure 12A:
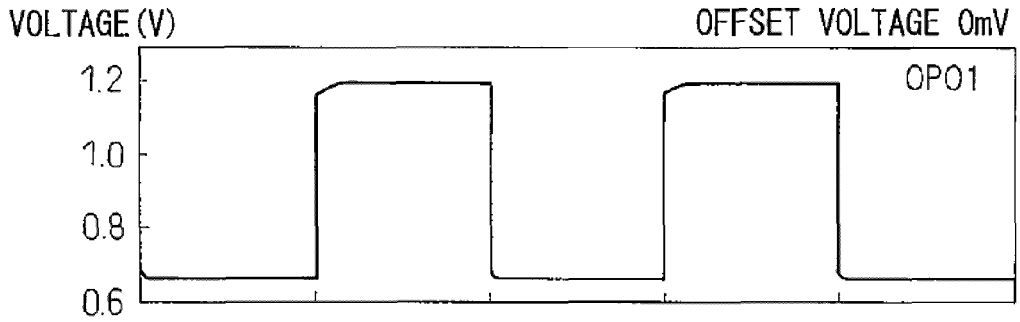
FIGS. 12A to 12D are diagrams illustrating an example of operating waveforms of the constant-voltage generating circuit of the first embodiment.
Figure 12B:
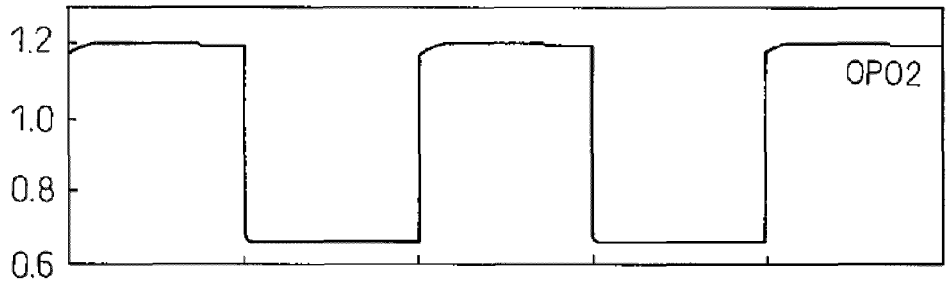
Figure 12C:
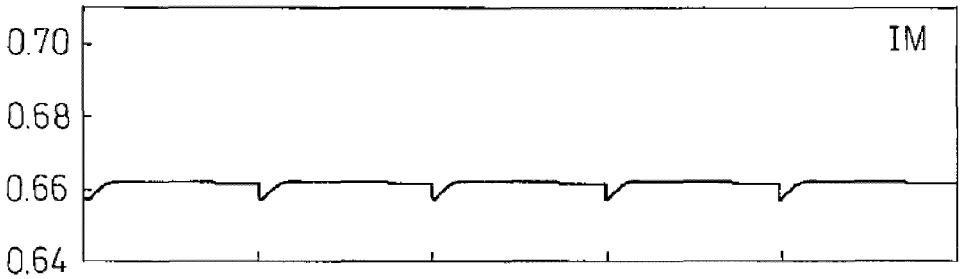
Figure 12D:
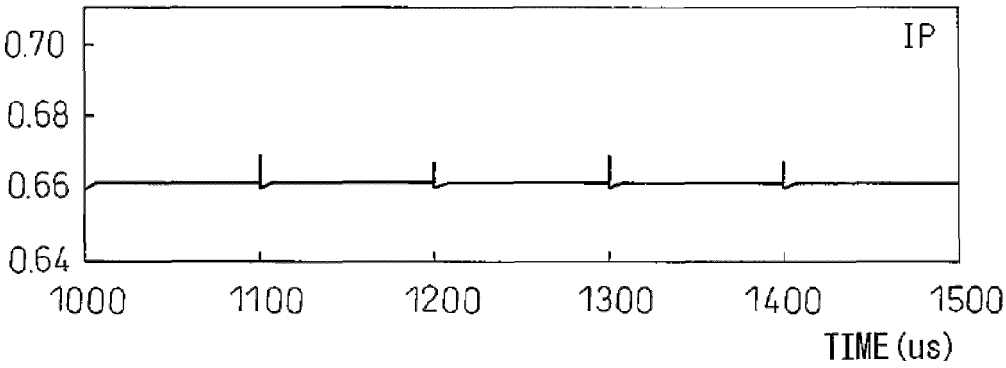

FIGS. 12A to 12D illustrate examples of the operating waveforms of various portions when the offset voltages VOFF1 and VOFF2 are zero. FIG. 12A illustrate the output OPO1 of IAMPAZ1, and FIG. 12B illustrates the output OPO2 of IAMPAZ2. FIG. 12C illustrates the waveform of the potential IM, and FIG. 12D illustrates the waveform of the potential IP. The abscissa represents the time, and the ordinate the potential. In each waveform diagram hereinafter given, the abscissa represents the time, and the ordinate the voltage, unless specifically stated otherwise. The potentials OPO1 and OPO2 respectively alternate between 1.2 V and about 0.6 V (0.66 V) in such a manner that when OPO1 is 1.2 V, OPO2 is 0.66 V and, when OPO1 is 0.66 V, OPO2 is 1.2 V. This is because the auto-zero period and the BGR feedback amplifier period are repeated, one alternating with the other, as previously described with reference to FIG. 8.

As can be seen from FIGS. 12A to 12D, the potentials IM and IP are both maintained at about 0.66 V which is the emitter potential of Q1, that is, IP and IM are at approximately the same potential. This demonstrates the operation of the bandgap circuit that performs feedback control so that the potential IM becomes identical with the potential IP.

Figure 13A:
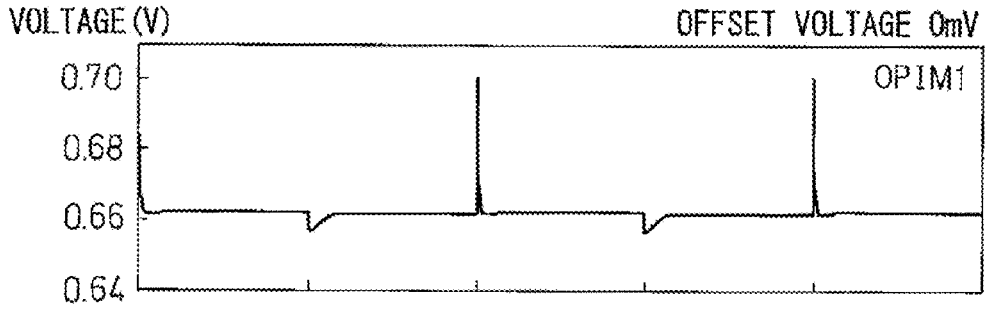
FIGS. 13A to 13D are diagrams illustrating an example of operating waveforms of the constant-voltage generating circuit of the first embodiment.
Figure 13B:
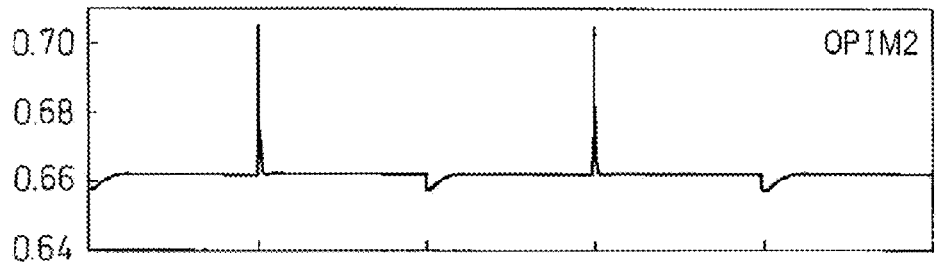
Figure 13C:
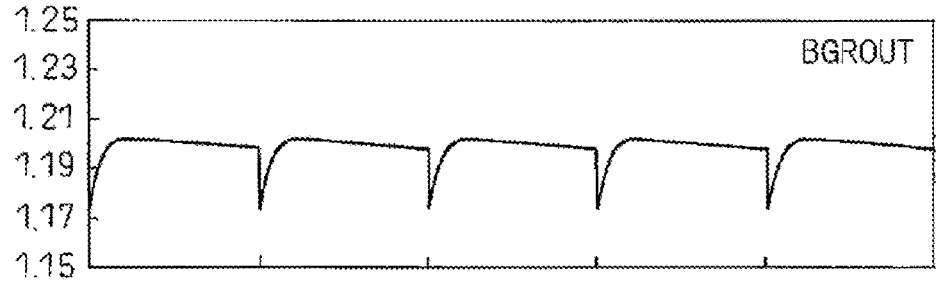
Figure 13D:
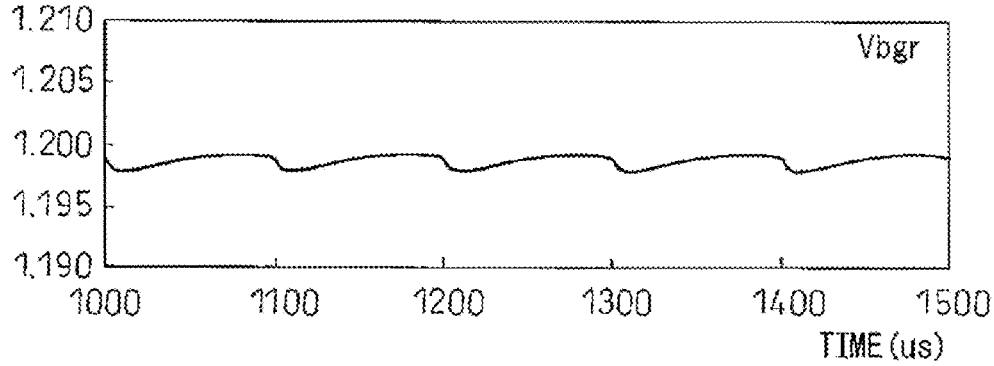

FIGS. 13A to 13D illustrate examples of the waveforms of OPIM1, OPIM2, BGROUT, and Vbgr as seen along the same time axis. As in FIGS. 12A to 12D, the offset voltages VOFF1 and VOFF2 are zero. FIG. 13A illustrates OPIM1, FIG. 13B illustrates OPIM2, FIG. 13C illustrates BGROUT, and FIG. 13D illustrates Vbgr.

OPIM1 and OPIM2 correspond to the negative inputs of the respective amplifiers containing the respective offset voltages. In the examples of FIGS. 13A to 13D, since the offset voltage is zero, OPIM1 and OPIM2 are at approximately the same potential as IM. BGROUT is produced by extracting, using switches, the 1.2-V portions of OPO1 and OPO2 illustrated in FIGS. 12A and 12B. As illustrated in FIG. 13C, BGROUT drops to about 1.18 V during switching. These glitches are smoothed out by the LPF to produce Vbgr illustrated in FIG. 13D. The smoothed voltage becomes slightly lower than 1.2 V due to the glitches, but it can be seen that the circuit operates as previously described with reference to FIGS. 5 and 8.

Figure 14A:
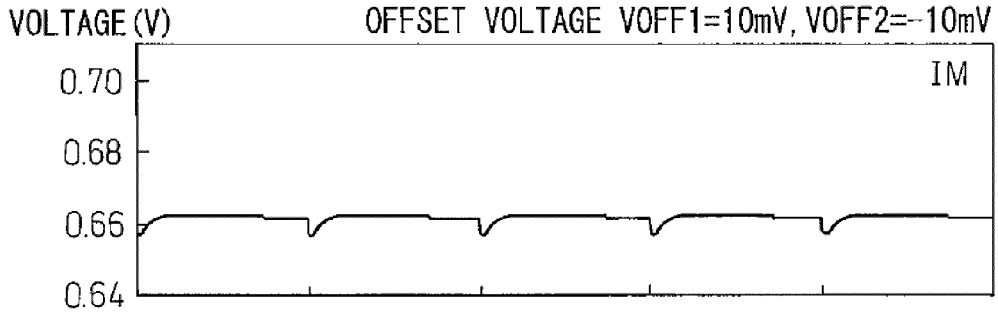
FIGS. 14A to 14D are diagrams illustrating an example of operating waveforms of the constant-voltage generating circuit of the first embodiment.
Figure 14B:
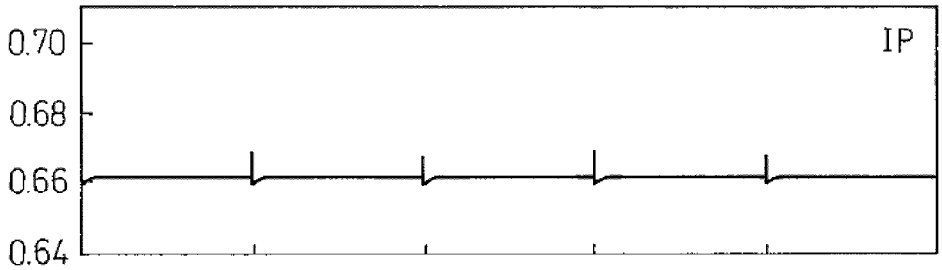
Figure 14C:
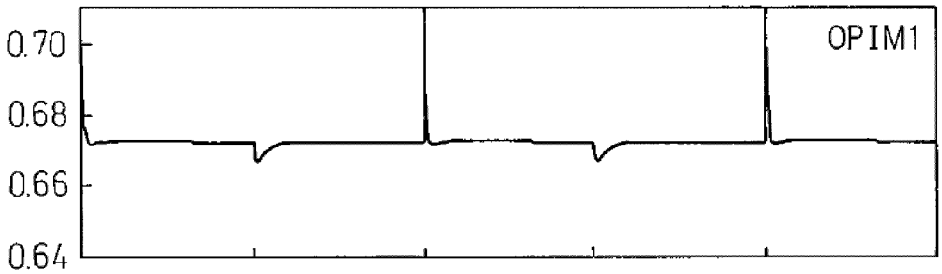
Figure 14D:
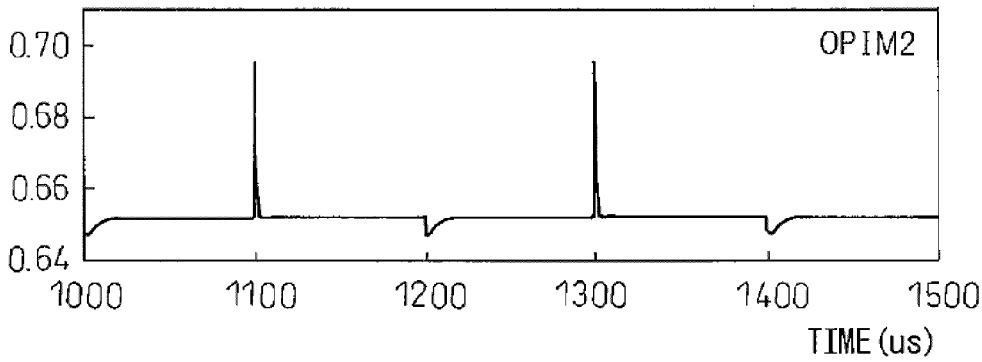

FIGS. 14A to 14D illustrate examples of the waveforms of various portions when VOFF1 and VOFF2 in FIG. 11 are set to +10 mV and −10 mV, respectively. FIG. 14A illustrates the waveform of IM, FIG. 14B illustrates the waveform of IP, FIG. 14C illustrates the waveform of OPIM1, and FIG. 14D illustrates the waveform of OPIM2.

It can be seen from FIGS. 14A and 14B that even when VOFF1 and VOFF2 are not zero, IP and IM are maintained at approximately the same potential in the circuit of the present embodiment, achieving the effect of auto-zero (offset compensation). On the other hand, since VOFF1 is set to +10 mV, the potential at OPIM1 in FIG. 14C is higher by 10 mV than that illustrated in FIG. 13A. By storing this potential difference in CAZ1, it becomes possible to control IP and IM to the same potential despite the presence of the offset voltage.

Likewise, the potential at OPIM2 in FIG. 14D is lower by 10 mV than that illustrated in FIG. 13B. This is because VOFF2 is set to −10 mV. Since the offset potential of VOFF2 is stored in CAZ2, if OPIM2 and IP are not at the same potential the effective offset voltage as seen from IM and IP can be reduced to zero, thus achieving control close to that of an ideal amplifier that controls IP and IM to the same potential.

The operation of the circuit of FIGS. 5 and 8 has been described above with reference to the waveform diagrams, including the offset voltages illustrated in FIG. 11. As illustrated in the waveform diagrams, despite the presence of a finite offset voltage, the operation to produce the BGR output voltage independent of the offset voltage can be achieved by storing the offset voltage in the capacitor and by using the amplifier as a feedback amplifier after the auto-zero operation.

Figure 15:
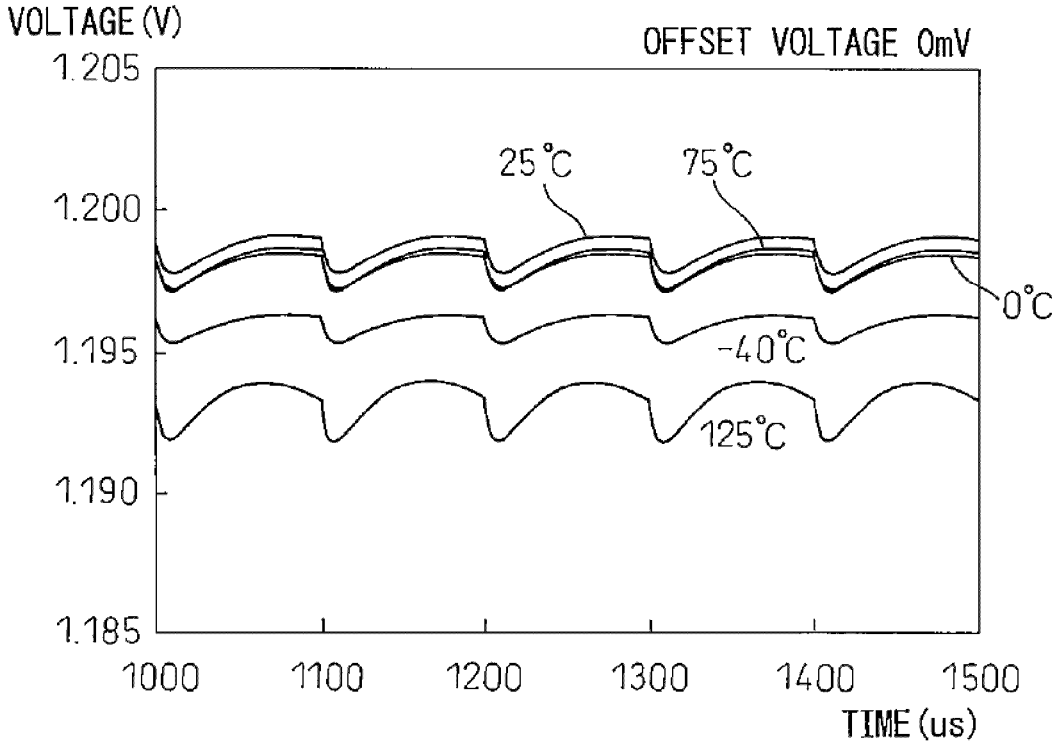
FIG. 15 is a diagram illustrating one example of the relationship between temperature, output voltage, and offset voltage in the constant-voltage generating circuit of the first embodiment.

FIG. 15 illustrates the relationship between Vbgr and temperature when the offset voltages VOFF1 and VOFF2 are set to zero in the circuit of FIG. 11. The abscissa represents the time, and the ordinate the voltage. The voltage Vbgr is illustrated with the temperature as a parameter. Though potential variations of several millivolts are present in Vbgr even after smoothing by the LPF, it can be seen that even when the temperature is varied from −40° C. to 125° C. (−40° C., 0° C., 25° C., 75° C., and 125° C.), substantially constant Vbgr is obtained and the circuit operates as a bandgap circuit. It can also be seen that a characteristic that is convex upward with increasing temperature is obtained, as in the case of FIG. 10.

Figure 16:
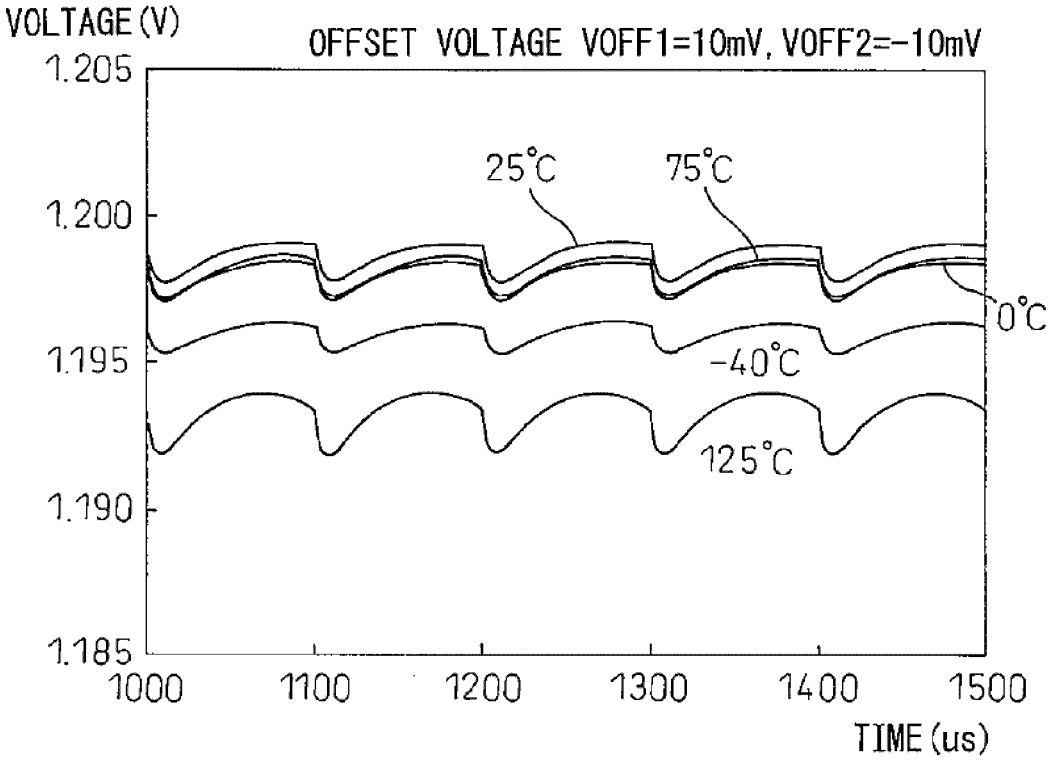
FIG. 16 is a diagram illustrating one example of the relationship between temperature, output voltage, and offset voltage in the constant-voltage generating circuit of the first embodiment.

FIG. 16 illustrates the relationship between Vbgr and temperature when VOFF1 and VOFF2 in FIG. 11 are set to +10 mV and −10 mV, respectively. As in FIG. 15, the abscissa represents the time, and the ordinate the voltage. The voltage Vbgr is illustrated with the temperature as a parameter. As can be seen from a comparison between FIG. 16 and FIG. 15, the voltage waveform of substantially the same characteristic is obtained independently of the offset voltage. (The voltage Vbgr first rises as the temperature rises, and then begins to decrease as the temperature further rises. Many BGR circuits exhibit such a characteristic.)

In this way, unlike the prior art chopper-stabilized bandgap circuit, a Vbgr waveform that does not depend on the offset voltage can be obtained according to the present embodiment. This has the effect that the LPF can be designed optimally without regard to the offset voltage.

The features of the constant-voltage generating circuit of the first embodiment described above are as follows.

(1) Rather than provide a single amplifier and operate it as a chopper, two amplifiers are provided.

(2) One of the amplifiers is operated as an auto-zero amplifier (AMPAZ2 in FIG. 6), and the input-referred offset voltage is stored in the capacitor (CAZ2 in FIG. 6). After the offset voltage has been stored, the amplifier is operated as a BGR feedback amplifier (AMPAZ2 in FIG. 7). In the BGR feedback amplifier period, the offset voltage of the amplifier is canceled out using the voltage stored in the capacitor (CAZ2).

(3) While one of the two amplifiers is being operated as a BGR feedback amplifier (AMPAZ2 in FIG. 7), the other amplifier (AMPAZ1) is operated as an auto-zero amplifier to store the offset of the amplifier. In other words, the two amplifiers are alternately used as a BGR feedback amplifier. By alternately using the amplifiers in which the offset has been canceled out, a bandgap circuit that does not contain errors associated with the offset voltage can be produced.

(4) For faster switching of the amplifiers, two phase compensation capacitors are provided for each amplifier (FIG. 8). The two phase compensation capacitors (CC1A and CC1B) are used by switching from one to the other between the offset storing period and the BGR feedback amplifier period.

In the prior art chopper-stabilized BGR of the configuration such as illustrated in FIG. 3A, an error voltage whose magnitude is, for example, six times as large as that of the offset voltage of the amplifier is added as an AC signal to the output voltage. The amplitude of the AC signal is, for example, six times as large as that of the offset voltage, and the LPF has had to be designed so as to sufficiently attenuate the AC signal by predicting the maximum value of the offset voltage.

On the other hand, in the configuration of FIGS. 5, 6, and 7, the error voltage caused by the offset voltage does not appear as AC components in the output BGROUT. The purpose of the LPF is to remove the glitch components that occur during the switching of the amplifiers. Since the glitch components are independent of the offset voltage of the amplifier, the LPF can be designed without regard to the offset voltage of the amplifier.

Figure 17:
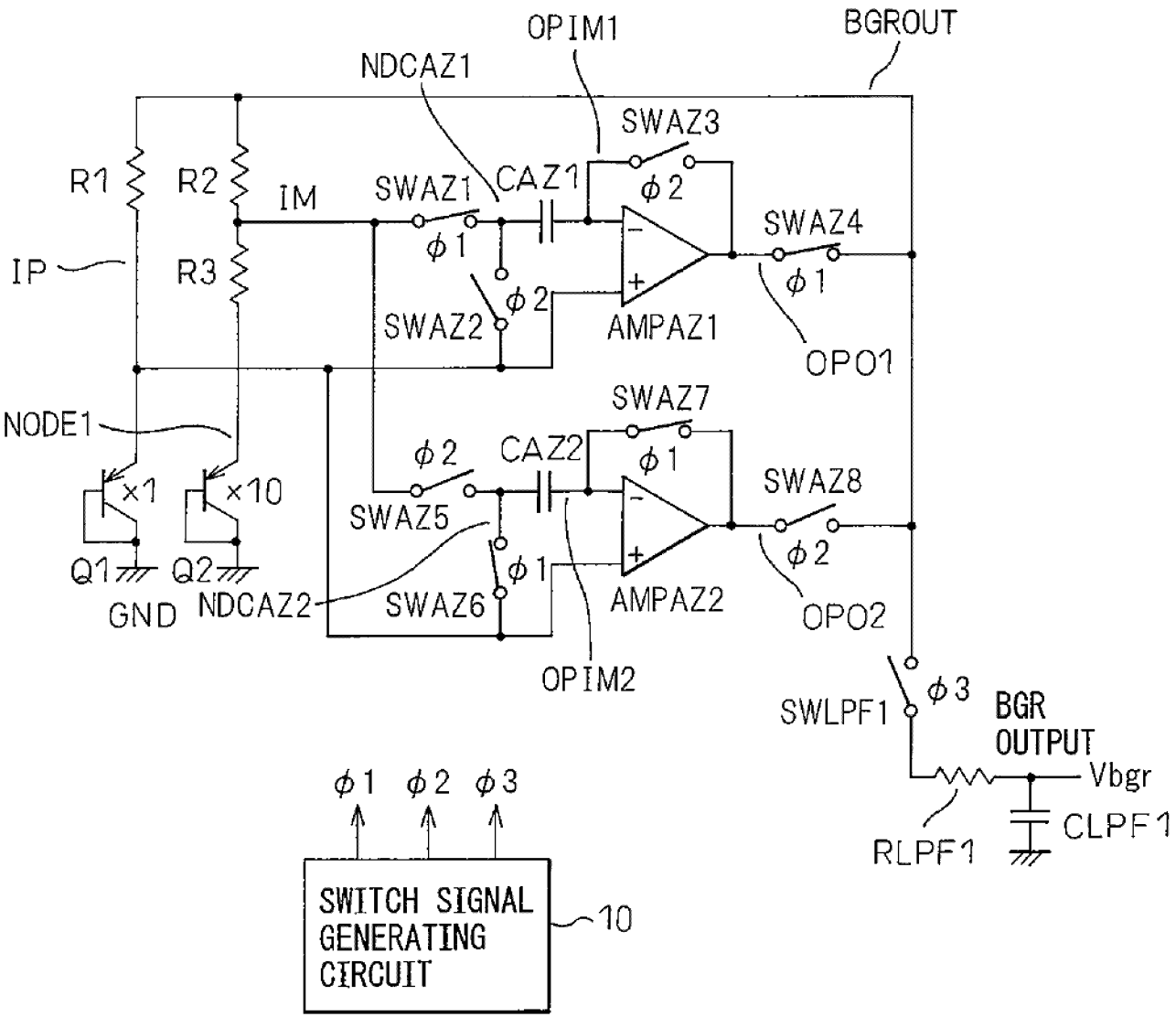
FIG. 17 is a diagram illustrating the circuit configuration of a constant-voltage generating circuit according to a second embodiment.

FIG. 17 is a diagram illustrating the basic configuration of a constant-voltage generating circuit according to a second embodiment.

The circuit of FIG. 17 differs from the circuit of FIGS. 5 and 8 only in that a switch SWLPF1 is added and the switch signal generating circuit 10 is configured to also generate a signal ϕ3. Here, SWLPF1 is controlled by ϕ3 as will be described hereinafter.

As previously described with reference to FIGS. 5, 8, 11, and 12, the potentials OPO1 and OPO2 respectively alternate between the potential IP and the bandgap potential of 1.2 V. Here, glitches associated with the transition occur on BGROUT, and these glitches are smoothed out by the LPF. When the potential OPO1 changes from 0.6 V to 1.2 V, SWAZ4 must be in the ON state so that AMPAZ1 is incorporated into the feedback loop of the BGR circuit. That is, it is not until after SWAZ4 is turned on that the potential OPO1 begins to change from 0.6 V, the potential IP, to 1.2 V. While this transition period can be shortened by providing two phase compensation capacitors and using them by switching from one to the other, as illustrated in FIG. 8, it is not possible in principle to reduce the transition period to zero.

In view of this, in the circuit of the present embodiment illustrated in FIG. 17, SWLPF1 is provided which operates to disconnect BGROUT from the LPF (RLPF1, CLPF1) during the transition period of OPO1 as well as the transition period of OPO2. In this way, by providing SWLPF1 and disconnecting BGROUT from the LPF during the glitch period where the potential on BGROUT changes greatly, potential variations of Vbgr can be further suppressed. This permits a reduction in the size of the capacitor used in the LPF.

Figure 18:
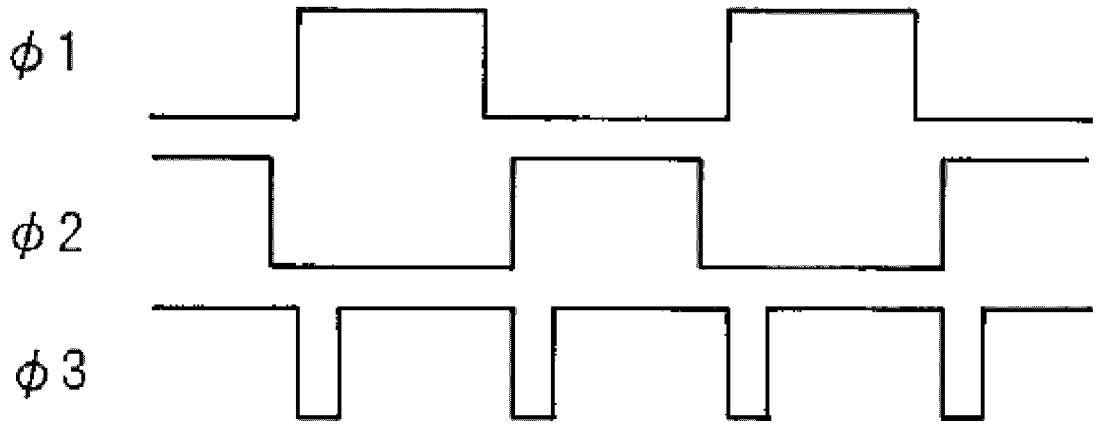
FIG. 18 is a diagram illustrating an example of operating signals of the constant-voltage generating circuit of the second embodiment.

FIG. 18 illustrates an example of the control signals used in FIG. 17. As previously described, the H period of ϕ1 (the ϕ1 period) alternates with the H period of ϕ2 (the ϕ2 period). At the beginning of the ϕ1 period, AMPAZ1 switches from the auto-zero operation to the BGR operation. Likewise, at the beginning of the ϕ2 period, AMPAZ2 switches from the auto-zero operation to the BGR operation. During the respective switching periods, OPO1 and OPO2 respectively change from the potential of about 0.6 V to the potential of 1.2 V, causing a glitch to occur on BGROUT. SWLPF1 is ON during the H period of ϕ3. Control is performed so that ϕ3 falls to L at the beginning of the ϕ1 period and also at the beginning of the ϕ2 period. With this control, BGROUT can be disconnected from Vbgr during the period where the potential on BGROUT changes greatly. The potential of Vbgr itself is retained in the capacitor CLPF1 during the L period of ϕ3.

Figure 19:
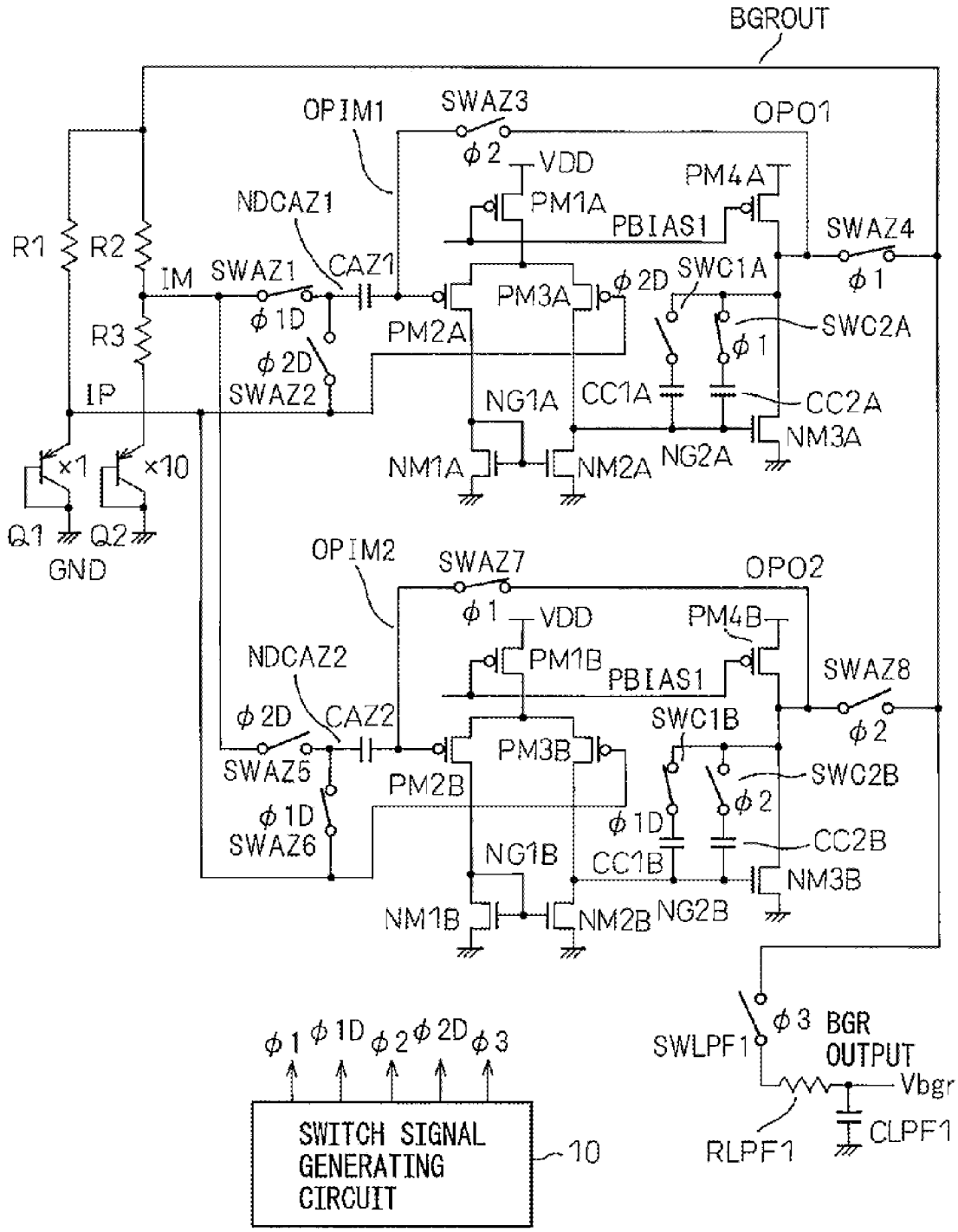
FIG. 19 is a diagram illustrating a circuit configuration in a modified example of the constant-voltage generating circuit of the second embodiment.

FIG. 19 is a diagram illustrating a circuit configuration in a modified example of the second embodiment of FIG. 17. The circuit of FIG. 19 is essentially the same as the circuit of FIG. 8, except for some modifications. For the sake of brevity, only the differences between the circuit of FIG. 19 and the circuit of FIG. 8 will be described below.

The circuit of FIG. 19 differs from the circuit of FIG. 8 in that SWLPF1 is provided as in FIG. 17, in that the operation timing of some of the switches is changed, and in that the switch signal generating circuit 10 is configured to also generate ϕ1D and ϕ2D. The function of SWLPF1 is the same as that of SWLPF1 in FIG. 17.

Figure 20:
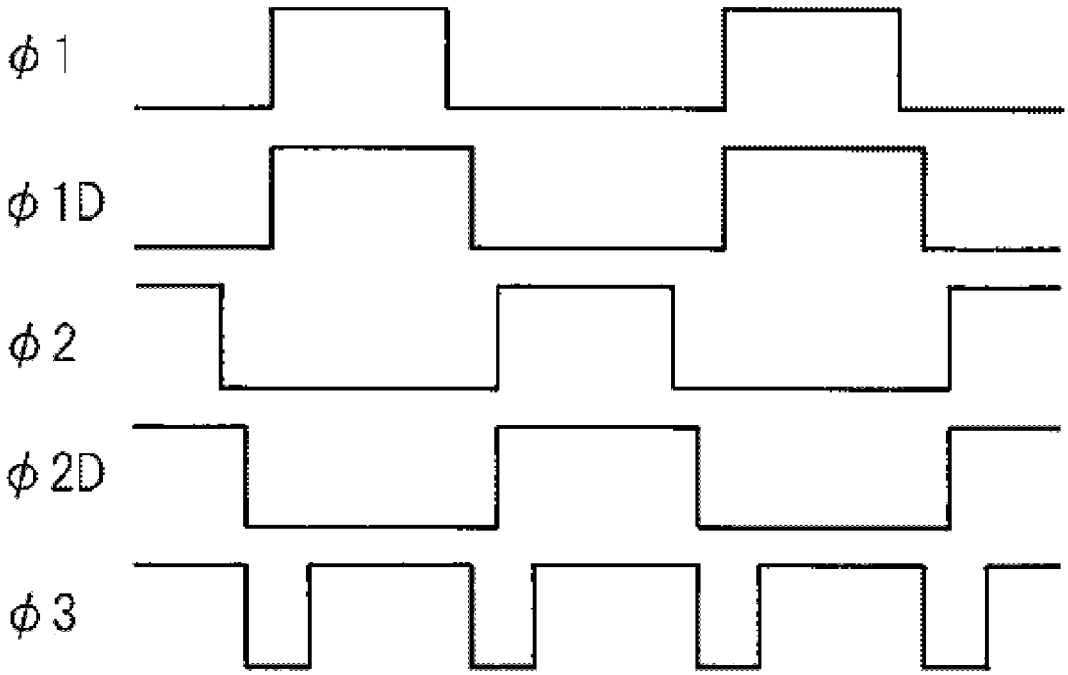
FIG. 20 is a diagram illustrating operating signals in the modified example of the constant-voltage generating circuit of the second embodiment.

In FIG. 8, the switches SWAZ1 to SWAZ8, SWC1A, SWC2A, SWC1B, SWC2B, etc. have been described as being controlled by the control signals ϕ1 and ϕ2. While the operation is basically the same as that described with reference to FIG. 8, the control timing for these switches can be modified in various ways, and FIG. 19 provides one modified example of the switch control timing. To clarify the correspondence, the switch names in FIG. 19 are the same as those used in FIG. 8, but in FIG. 19, some of the signal names illustrated alongside the switches are different from those illustrated in FIG. 8. FIG. 20 illustrates one example of the timing for the control signals ϕ1, ϕ1D, ϕ2, ϕ2D, etc.

In the circuit of FIG. 19, the timing control signal for SWAZ1 is ϕ1D. The timing control signal for SWAZ2 is changed from ϕ2 to ϕ2D. The timing control signal for SWC1A is also changed to ϕ2D. Further, the timing control signals for SWAZ5, SWAZ6, and SWC1B are changed to ϕ2D, ϕ1D, and ϕ1D, respectively.

As illustrated in FIG. 20, the timing difference between ϕ1 and ϕ1D is small, and the difference between ϕ2 and ϕ2D is also small, which means that the circuit operation is not greatly changed from that described with reference to FIG. 8; the following describes the reason for changing the signal timing as illustrated.

The only difference between ϕ1D and ϕ1 is that the fall timing of the former is delayed with respect to that of the latter. Likewise, the only difference between ϕ2D and ϕ2 is that the fall timing of the former is delayed with respect to that of the latter. It will also be noted that the H period of ϕ1D does not overlap the H period of ϕ2D. The reason for controlling the timing of SWAZ6 by ϕ1D, SWAZ7 by ϕ1, and SWC1B by ϕ1D will be described below.

In AMPAZ2, the timing of SWAZ6 is controlled by ϕ1D. On the other hand, the timing of SWAZ7 is controlled by ϕ1. That is, SWAZ7 is turned off before SWAZ6 is turned off. This means that SWAZ7 can be turned off while holding NDCAZ2 at the same potential as IP via SWAZ6. Since this puts the one node OPIM2 of CAZ2 into a floating state, the offset voltage can be accurately stored in CAZ2 without being affected by SWAZ6. For the same reason, the timing of SWC1B is controlled by ϕ1D so that SWC1B is turned off after the state of SWAZ7 has changed.

In AMPAZ1, ϕ1 and ϕ1D are replaced with ϕ2 and ϕ2D, respectively, but here also, the reason that only SWAZ3 is controlled by ϕ2 while SWC1A and SWAZ2 are controlled by ϕ2D is that the offset voltage can be accurately stored in CAZ1.

On the other hand, in AMPAZ1, the timing of SWAZ4 and SWC2A is controlled by ϕ1, while the timing of SWAZ1 is controlled by ϕ1D. This is because the charge can then be accurately stored on CC2A. When SWAZ4 and SWC2A are simultaneously turned off, SWAZ1 is still held in the ON state. Specifically, at the same time that the BGR feedback loop is disconnected, putting BGROUT in a floating state, the switch for CC2A is turned off, and the charge when BGROUT is in the steady state is stored on CC2A. Since the charge on CC2A is not affected by the turning off of SWAZ1, speedup in processing can be achieved by minimizing the amount of charge/discharge of CC2A when CC2A is selected the next time. The above description also applies to the control signals ϕ2 and ϕ2D for the corresponding switches in AMPAZ2.

While the basic timing is the same as that described with reference to FIG. 8, the actual detailed switch timing can be modified in various ways as described above.

The explanation of FIG. 20 will be continued. Since ϕ1, ϕ1D, ϕ2, and ϕ2D are used, as described with reference to FIG. 19, the timing of ϕ3 should be set so that BGROUT is disconnected from the LPF at the rise timing of ϕ1, ϕ1D, ϕ2, and ϕ2D, respectively. The waveform diagram of FIG. 20 illustrates an example in which ϕ3 falls before ϕ1, ϕ1D, ϕ2, and ϕ2D, respectively, rise, thereby ensuring that the glitch occurring on BGROUT will not be transmitted to Vbgr. After the rising of ϕ1, ϕ1D, ϕ2, and ϕ2D, respectively, ϕ3 is held at L for a short duration and, after waiting for the potential on BGROUT to stabilize, SWLPF1 is turned on to connect BGROUT to the LPF. The timing of ϕ3 also can be adjusted without departing from the spirit and scope of the present embodiment.

Figure 21:
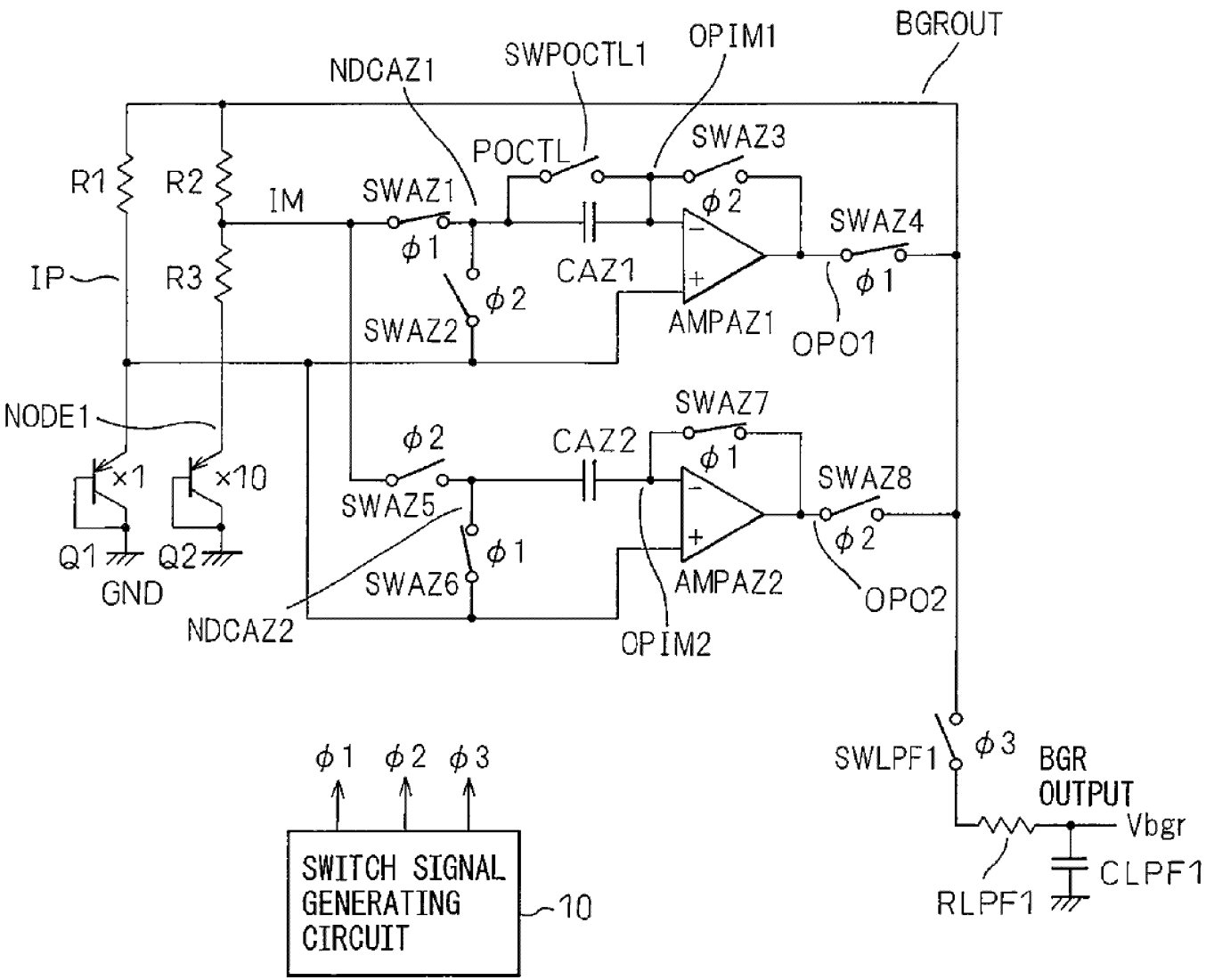
FIG. 21 is a diagram illustrating the circuit configuration of a constant-voltage generating circuit according to a third embodiment.

FIG. 21 is a diagram illustrating the configuration of a constant-voltage circuit according to a third embodiment. The only difference between the circuit of FIG. 21 and the circuit of FIG. 17 is the inclusion of a switch SWPOCTL1 the function of which will be described below.

The switch SWPOCTL1 acts as a device that initializes the potential difference across CAZ1 to zero at power on so that a bandgap voltage with reasonable accuracy can be obtained as Vbgr during power up. In the circuit of FIG. 21, it is assumed that ϕ1 is H and ϕ2 is L when power is turned on (i.e. control is performed so that ϕ1 goes H and ϕ2 goes L; here, each switch illustrated with ϕ1 is ON during the H period of ϕ1, and each switch illustrated with ϕ2 is ON during the H period of ϕ2). It is also assumed that control is performed so that ϕ3 goes H when power is turned on. Further, it is assumed that control is performed so that a control signal POCTL for SWPOCTL1 goes H immediately after power on, and goes L when the clock ϕ2 goes H.

The concept of the bandgap circuit of the present embodiment has been described above by taking the circuit of FIGS. 5 and 8 as an example. It has been described that the two amplifiers are used in combination, one being operated as an auto-zero amplifier and the other as a bandgap circuit feedback amplifier and vice versa in alternating fashion under the control of the two clocks ϕ1 and ϕ2. However, there arises the problem that stable clocks ϕ1 and ϕ2 cannot be supplied during power on or immediately after power on. This is because when the supply voltage is zero, the oscillation circuit that supplies the clocks is off as a matter of course and, even after power is turned on, it will take a finite time for the oscillation circuit to become ready to supply stable clocks.

There are cases where it is desirable to output a bandgap voltage with reasonable accuracy, if not high accuracy, during power on or immediately after power on. For example, in the case of a regulator circuit constructed using the BGR circuit of the embodiment, it is desirable to deliver supply voltage, for example, to the internal circuitry of the MCU at the earliest possible time, immediately after power on. Assuming the use in such a regulator circuit, the circuit configuration such as illustrated in FIG. 21 is desirable.

In the circuit of FIG. 21, during power on or immediately after power on when it is not yet ready to supply stable clocks (control signals) ϕ1 and ϕ2, the circuit is operated in a manner similar to the prior art circuit of FIG. 1, thereby making it possible to output the bandgap voltage at the earliest possible time. Then, when the voltage for the internal circuitry is supplied using, for example, the regulator circuit, and the circuit becomes ready to supply the clocks ϕ1 and ϕ2, the circuit starts to operate by switching the amplifier operation between the auto-zero operation and the bandgap circuit feedback amplifier operation in alternating fashion as described with reference to the circuit of FIGS. 5 and 8. The circuit is thus switched to the operation mode that can supply the bandgap voltage of higher accuracy.

Figure 22:
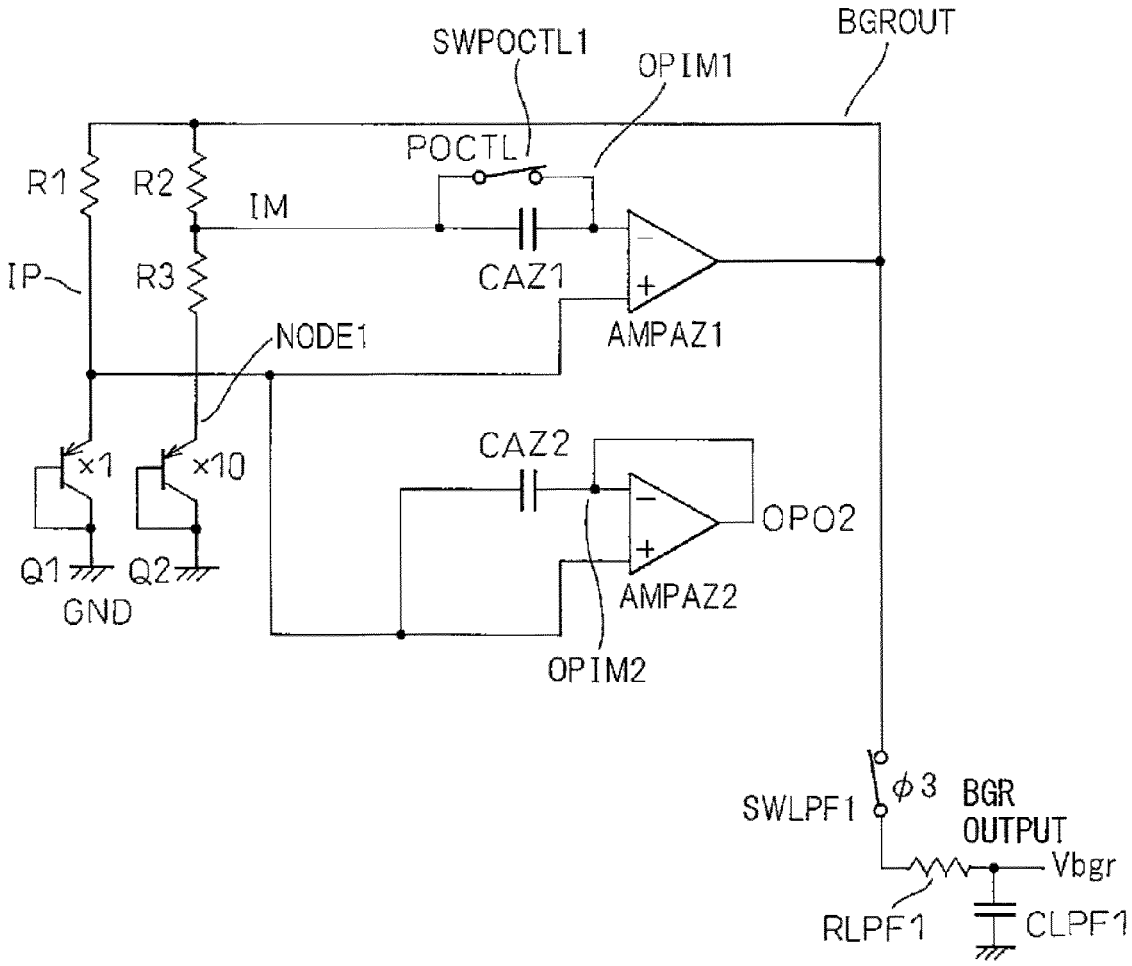
FIG. 22 is a diagram for explaining the operation of the constant-voltage generating circuit of the third embodiment.

Referring to FIG. 22, a description will be given of the power-on control and state of the circuit of the third embodiment illustrated in FIG. 21. When power is turned on, since ϕ1 is H, SWAZ1 is ON. SWAZ4 is also ON. When power is turned on, since ϕ2 is L, SWAZ2 is OFF. SWAZ3 is also OFF.

Likewise, SWAZ5 is OFF, SWAZ6 is ON, SWAZ7 is ON, and SWAZ8 is OFF. When ϕ1 is set to H and ϕ2 to L upon power on, the states of SWAZ1 to SWAZ8 are the same as those in the circuit of FIGS. 5 and 8 during the ϕ1 period.

In normal operation during the ϕ1 period, the offset voltage of AMPAZ1 is canceled by applying a potential to OPIM1 based on the potential difference stored in CAZ1. However, whether the charge on CAZ1 or the potential difference across it is at zero or at some other value when power is turned on depends on the waveform of the supplied power, and its value is not uniquely determined. Therefore, there is no guarantee that OPO1 will be set to the intended value when the potential is applied to the input OPIM1 of AMPAZ1 via CAZ1. In an extreme case, the potential difference across CAZ1 may be about 0.5 V when the actual offset voltage is about +10 mV. In such a case, the potential at OPO1 departs widely from the bandgap voltage. To solve this problem, the circuit of FIG. 21 includes SWPOCTL1, which is turned on at power on and held on until the circuit starts to supply the clocks (control signals) ϕ1 and ϕ2.

When the above circuit and control is employed, the negative input OPIM1 of AMPAZ1 is connected to IM via SWPOCTL1 and SWAZ1, thus DC-coupling IM to OPIM1. While the offset voltage of AMPAZ1 is not canceled out by CAZ1, the circuit operates in a manner similar to the prior art circuit of FIG. 1, and the bandgap voltage can be output with a voltage accuracy comparable to that of the circuit of FIG. 1. This has the effect that the regular circuit can be operated by providing the bandgap voltage at an early time before the circuit becomes ready to supply the clocks ϕ1 and ϕ2.

FIG. 22 illustrates an equivalent circuit representing the circuit of FIG. 21 when power is turned on. The negative input OPIM1 of AMPAZ1 is connected to IM via SWPOCTL1 (SWAZ1 is ON). The control signal POCTL for SWPOCTL1 goes H at power on and remains H until the circuit starts to supply the clocks (control signals) ϕ1 and ϕ2. By performing control so that SWLPF1 also is turned on at power on, the bandgap voltage is output as Vbgr.

In FIG. 22, AMPAZ2 is illustrated as operating in the auto-zero mode. By controlling the power-on state as illustrated in FIG. 22, when it becomes possible to supply the clocks, the circuit can immediately transition to the ϕ2 period. Alternatively, during power on, the switches for AMPAZ2 may be held in the same states as those illustrated in FIG. 22, and only AMPAZ2 may be put in the power-down state. After power up, AMPAZ2 may be operated, and thereafter the ϕ2 period and the ϕ1 period may be repeated cyclically.

Figure 23:
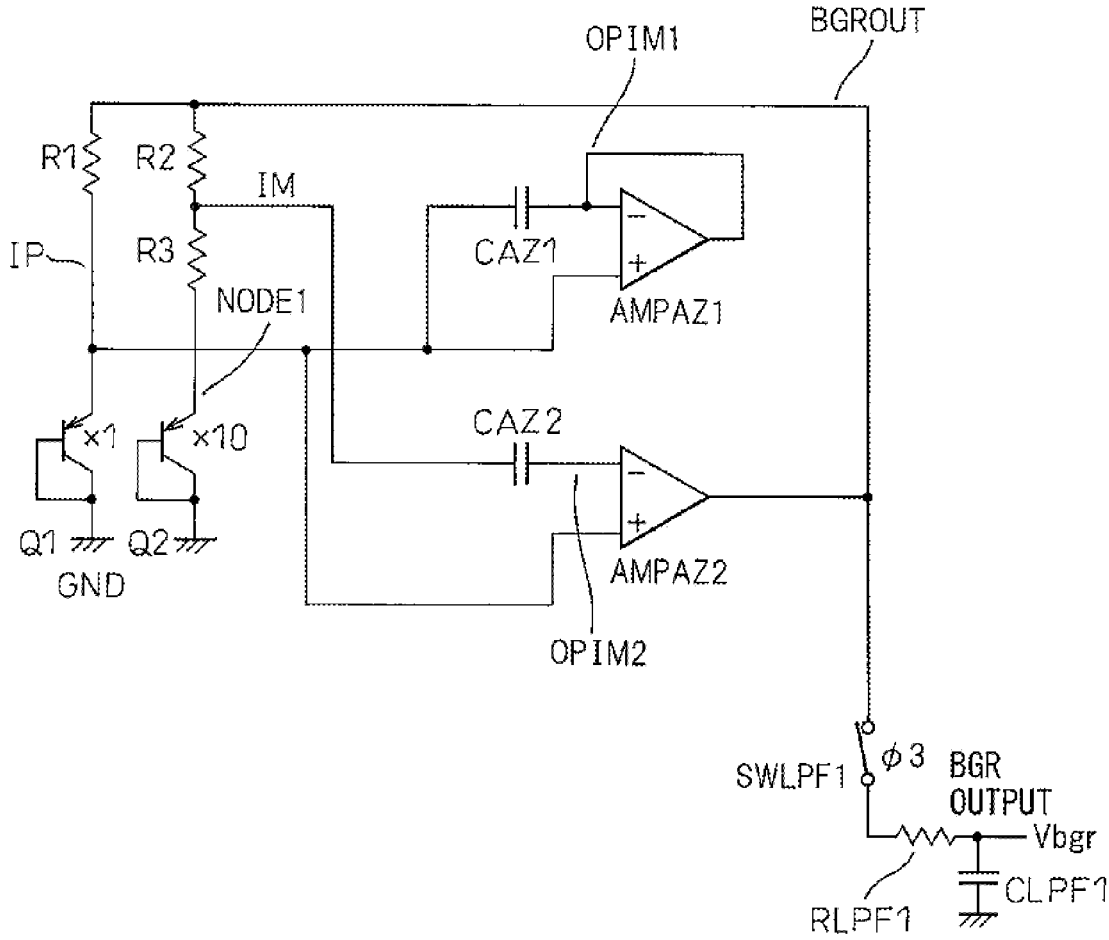
FIG. 23 is a diagram for explaining the operation of the constant-voltage generating circuit of the third embodiment.

FIG. 23 illustrates an example of operation and control in the state that follows the power-on state illustrated in FIG. 22. In FIG. 22, AMPAZ1 was operated in the same manner as the prior art bandgap circuit of FIG. 1 immediately after power on. In FIG. 23, it becomes possible to supply the clocks ϕ1 and ϕ2 and, with ϕ2 set to H, the circuit begins to operate in the same manner as the circuit of FIG. 5A in the ϕ2 period. Specifically, AMPAZ1 is operated to perform the auto-zero operation, and the offset voltage is stored in CAZ1. Using the offset voltage of AMPAZ2 stored in CAZ2 in the state immediately after power on (FIG. 22), the offset of AMPAZ2 is canceled out, and AMPAZ2 is operated to generate the BGR voltage. At the same time that ϕ2 is set to H and CAZ1 and CAZ2 are put to use, POCTL is set to L so that SWPOCTL1 remains off for the remainder of the operation.

Figure 24:
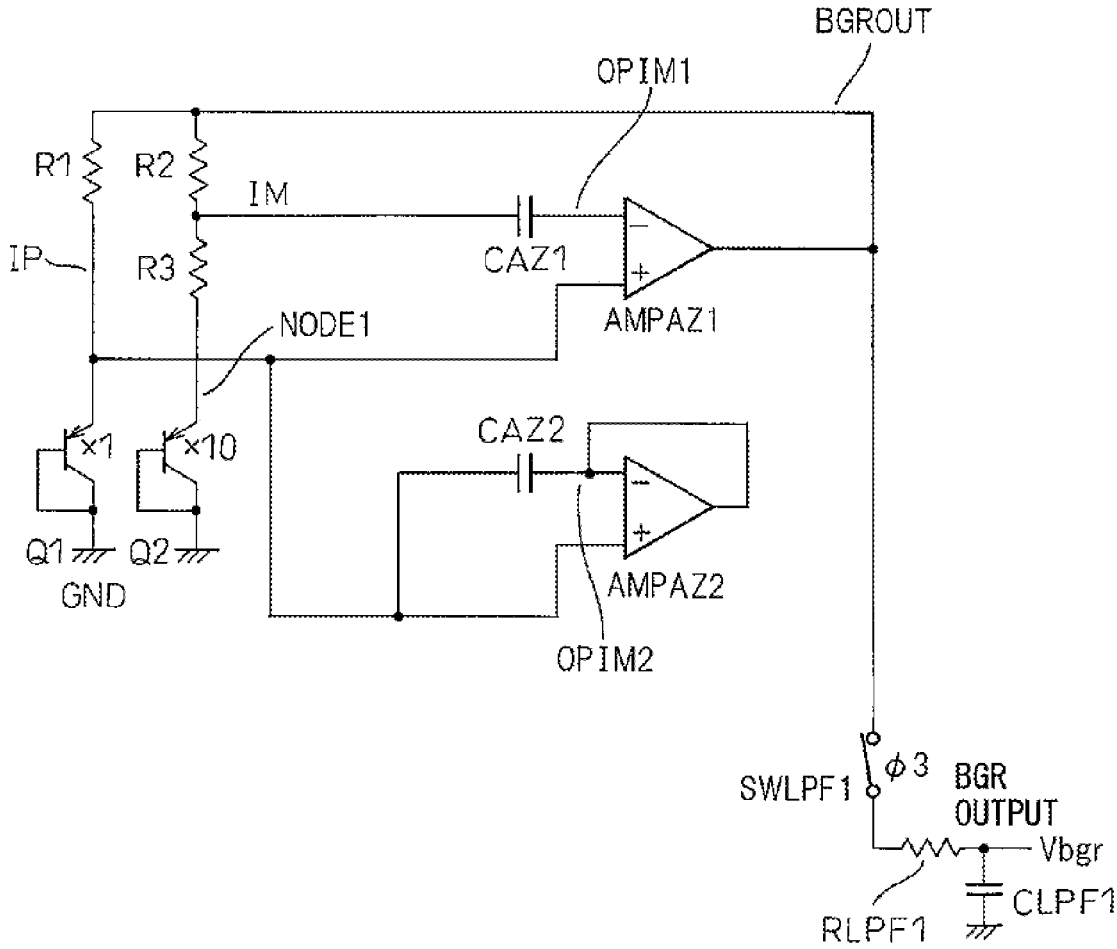
FIG. 24 is a diagram for explaining the operation of the constant-voltage generating circuit of the third embodiment.

FIG. 24 illustrates the state that follows the ϕ2 period illustrated in the state of FIG. 23. AMPAZ1 is operated to generate the bandgap voltage, and on the other hand, the voltage of AMPAZ2 is again stored in CAZ2. Using the offset voltage stored in CAZ1 as illustrated in FIG. 23, the offset voltage is canceled out. Thereafter, the operation cycles alternately between the ϕ1 period illustrated in FIG. 24 and the ϕ2 period illustrated in FIG. 23.

As described above, the circuit of FIG. 21 has the effect of achieving the earliest possible rising of the output voltage after power on, while retaining the advantage that the bandgap voltage of high accuracy can be generated by the operation of the BGR circuit of the present embodiment as described up to FIG. 19, and the circuit can thus be advantageously applied to a regulator circuit or the like.

Using the bandgap circuit according to any one of the first to third embodiments described above, the bandgap voltage can be generated that is not affected by the offset voltage of the CMOS amplifier. Since the glitch that occurs on the output during switching between the two amplifiers does not depend on the offset voltage, the LPF can be designed independently of the maximum value of the offset voltage, and the area that the LPF occupies can be reduced.

By providing two phase compensation capacitors for each amplifier as illustrated in the first embodiment, faster switching between the amplifiers can be accomplished, and the output glitch (potential variation) can be suppressed.

Further, by providing a switch (SWLPF1 in FIG. 17) that works to disconnect the LPF from the amplifier output during the switching of the amplifiers in order to reduce the output glitch during the switching, as in the second embodiment, the output glitch (potential variation) that occurs during the switching of the amplifiers can be prevented from being transmitted to the output of the LPF.

Furthermore, by initializing the potential difference across the offset storing capacitor to zero at power on, as in the third embodiment, it becomes possible to generate the bandgap voltage before the clocks are supplied, and the output voltage of the regulator circuit, etc. can thus be made to rise at the earliest possible time.

Next, as an application example, a regulator having a constant-voltage generating circuit as described in any one of the first to third embodiments will be described below.

A microcomputer (MCU) is used as a programmable component in an electronic apparatus. With advances in semiconductor processing technology, i.e. miniaturization technology, the range of applications of MCUs has been increasing at a rapid pace. The reason for this is that, with advances in miniaturization technology, the processing capabilities of the MCUs have been improving and the cost per function has been decreasing. As device geometries decrease, the voltage withstanding capabilities of microstructure MOS transistors forming digital circuits have been decreasing. For example, supply voltage for a CMOS circuit with a gate length of 0.18 μm is generally on the order of 1.8 V. On the other hand, in automotive applications, for example, it is often the case that the interface voltage to the MCU is required to satisfy the traditional 5-V specification. There are also cases where the supply voltage or interface voltage supplied from outside the MCU is required to be 5 V, while on the other hand, 1.8 V needs to be used as the supply voltage to digital circuitry due to the voltage withstanding capabilities of the internal circuitry. In such cases, to reduce the number of external components it is standard practice to equip the MCU with a series regulator which generates 1.8-V power from the externally supplied 5-V power and supplies the 1.8-V power to the internal digital circuitry.

Figure 25:
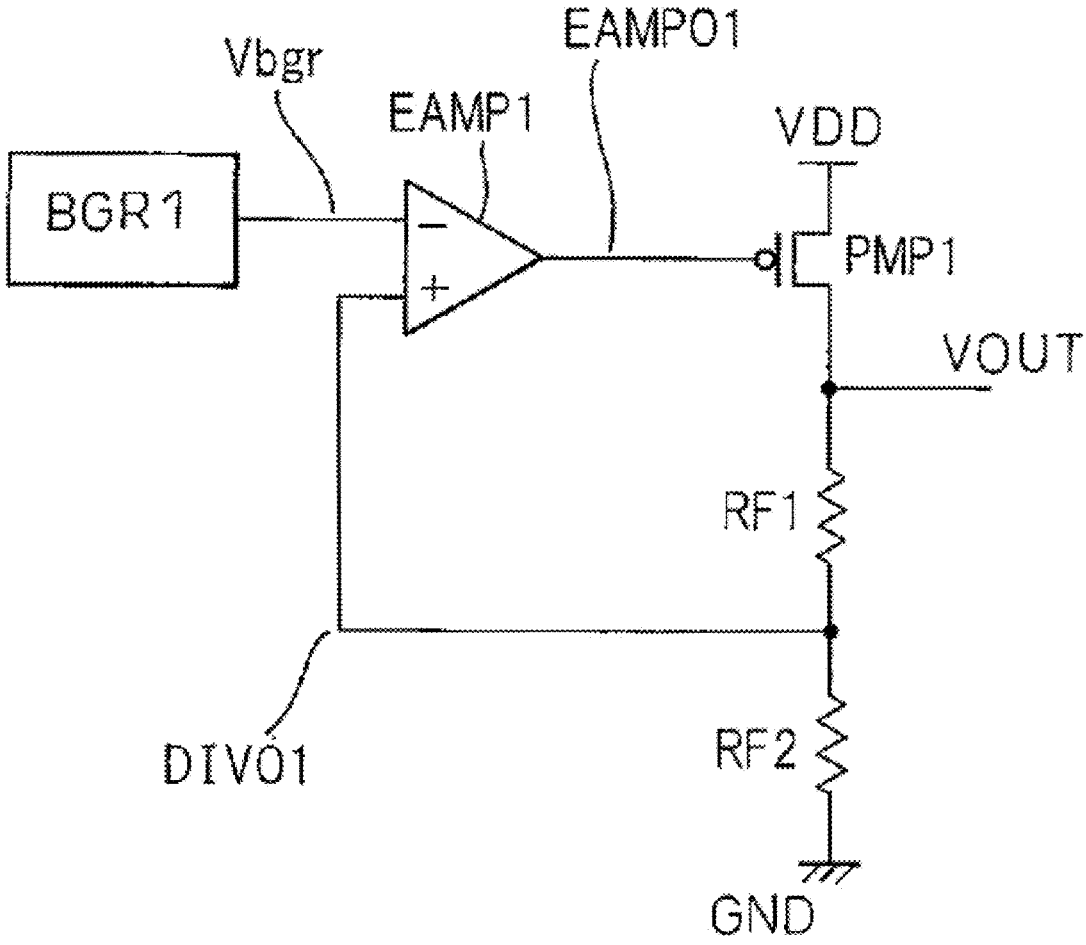
FIG. 25 is a diagram illustrating a regulator circuit that utilizes the constant-voltage generating circuit of the embodiment.

FIG. 25 is a diagram illustrating one example of the series regulator circuit, illustrating a typical configuration of a series regulator which generates 1.8-V power from the externally supplied 5-V power. The series regulator includes a bandgap circuit BGR1 for generating a reference voltage, an error amplifier EAMP1, an output transistor PMP1, and a resistive voltage-dividing circuit for dividing the regulator output voltage. The resistive voltage-dividing circuit includes resistors RF1 and RF2 between which the regulator output voltage is divided. In FIG. 25, Vbgr represents the reference voltage that the bandgap circuit BGR1 outputs, while EAMPO1 designates the output of the error amplifier EAMP1, VOUT the regulator output, DIVO1 the output of the resistive voltage-dividing circuit, VDD the 5-V power supplied, for example, from the outside, and GND the ground potential (0 V).

In the regulator circuit of FIG. 25, the bandgap circuit BGR1 generates the bandgap voltage Vbgr (1.2 V), i.e., the reference voltage that does not depend on temperature or supply voltage. The resistive voltage-dividing circuit of RF1 and RF2 generates a divided voltage by dividing the regulator output voltage VOUT, for example, at ⅔. With the error amplifier EAMP1 controlling the gate of the output transistor PMP1, negative feedback control is performed so that the output of the resistive voltage-dividing circuit, DIVO1, becomes identical with the reference voltage (bandgap voltage) Vbgr (1.2 V).

Since the voltage DIVO1, which is equal to the regulator output multiplied by ⅔, is identical with the bandgap voltage Vbgr (1.2 V), the regulator output voltage VOUT, for example, is controlled to the constant voltage of 1.8 V (ideally) despite variations in temperature, supply voltage, and load current. Ideally, the bandgap voltage is about 1.2 V. As described with reference to FIGS. 1 and 2, the bandgap voltage is independent of temperature and supply voltage, but in practice, its output voltage changes from circuit to circuit due to such factors as variations in the MOS transistor used to form the CMOS bandgap circuit.

In a typical CMOS bandgap circuit, the output voltage varies, for example, within a range of ±8% or so of 1.2 V.

If the reference voltage Vbgr is, for example, 1.2 V±8%, then in the above example the regulator output voltage VOUT is also 1.2 V±8% (disregarding the offset voltage of the error amplifier), which is 1.2 V±140 mV if the variation range is expressed in terms of absolute value. This means that the regulator output voltage VOUT fluctuates within a range of 1.66 V to 1.94 V around 1.8 V.

Since the regulator output voltage VOUT provides a supply voltage to a logic circuit formed from a CMOS circuit with a gate length of 0.18 μm, it follows that in one sample, the supply voltage to the MCU logic circuit may become 1.66 V, while in another sample, the supply voltage to the MCU logic circuit may become 1.94 V.

If the supply voltage to the MCU logic circuit is low, the delay time of the basic circuit forming the logic circuit increases, which is disadvantageous from the viewpoint of operating frequency. On the other hand, it is desired to hold the upper limit of the supply voltage to the MCU logic circuit, for example, within 2.0 V from the standpoint of device reliability (for example, TDDB (Time-Dependent Dielectric Breakdown), hot carrier degradation, etc.).

If the error of the regulator output voltage is large, it becomes difficult to satisfy the upper limit of the supply voltage determined from the standpoint of reliability, while at the same time satisfying the lower limit of the supply voltage that the regulator outputs and that is determined by the operating speed requirement.

In view of the above, the constant-voltage generating circuit according to any one of the first to third embodiment is used as the bandgap circuit BGR1 in the regulator circuit of FIG. 25. When the constant-voltage generating circuit according to any one of the first to third embodiment is used as the bandgap circuit, a regulator circuit having a high output accuracy can be achieved.

In this way, the disclosed constant-voltage generating circuit of each embodiment does not perform chopper operation, but provides two amplifier units and performs switching between their outputs. The two amplifier units alternately perform the offset storing operation and the offset-compensating output producing operation in a complementary manner.

According to the embodiments, a constant-voltage generating circuit that generates a constant voltage independently of the offset voltage can be achieved by reducing the area it occupies.

While various embodiments have been described above, it will be easily understood by those skilled in the part that the techniques disclosed herein are not limited to the embodiments described above and that various modifications can be made to them.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A constant-voltage generating circuit comprising:

a reference potential generating unit which outputs a prescribed first potential that varies with a positive or negative temperature dependence in accordance with a potential on an output line, and a second potential that varies with an opposite temperature dependence to the positive or negative temperature dependence with respect to the potential on the output line;

a first amplifier unit which takes the first potential and the second potential as two inputs, and whose output is connected to the output line during a first operation period;

a second amplifier unit which takes the first potential and the second potential as two inputs, and whose output is connected to the output line during a second operation period; and a low-pass filter connected to the output line, and wherein the first operation period and the second operation period are repeated, one alternating with the other, the first amplifier unit stores offset voltage of the first amplifier unit during the second operation period, and produces an output, during the first operation period, that brings the first potential and the second potential equal to each other by canceling out the offset voltage using the stored offset voltage, and the second amplifier unit stores offset voltage of the second amplifier unit during the first operation period, and produces an output, during the second operation period, that brings the first potential and the second potential equal to each other by canceling out the offset voltage using the stored offset voltage.

2. The constant-voltage generating circuit according to claim 1, wherein the reference potential generating unit comprises:

a first pnp transistor and a first resistor connected in series between a ground terminal and the output line; and a second pnp transistor and second and third resistors connected in series between the ground terminal and the output line, and wherein the first potential is output from a connection node between the first pnp transistor and the first resistor, and the second potential is output from a connection node between the second and third resistors.

3. The constant-voltage generating circuit according to claim 1, wherein the first amplifier unit comprises a first CMOS operational amplifier whose positive input is connected to an input node of the first potential, a first offset capacitor whose one end is connected to an negative input of the first operational amplifier, a first switch connected between the other end of the first offset capacitor and an input node of the second potential, a second switch connected between the other end of the first offset capacitor and the input node of the first potential, a third switch connected between the negative input of the first operational amplifier and an output thereof, and a fourth switch connected between the output of the first operational amplifier and the output line, and the second amplifier unit comprises a second CMOS operational amplifier whose positive input is connected to the input node of the first potential, a second offset capacitor whose one end is connected to an negative input of the second operational amplifier, a fifth switch connected between the other end of the second offset capacitor and the input node of the second potential, a sixth switch connected between the other end of the second offset capacitor and the input node of the first potential, a seventh switch connected between the negative input of the second operational amplifier and an output thereof, and an eighth switch connected between the output of the second operational amplifier and the output line.

4. The constant-voltage generating circuit according to claim 2, wherein the first amplifier unit comprises a first CMOS operational amplifier whose positive input is connected to an input node of the first potential, a first offset capacitor whose one end is connected to an negative input of the first operational amplifier, a first switch connected between the other end of the first offset capacitor and an input node of the second potential, a second switch connected between the other end of the first offset capacitor and the input node of the first potential, a third switch connected between the negative input of the first operational amplifier and an output thereof, and a fourth switch connected between the output of the first operational amplifier and the output line, and the second amplifier unit comprises a second CMOS operational amplifier whose positive input is connected to the input node of the first potential, a second offset capacitor whose one end is connected to an negative input of the second operational amplifier, a fifth switch connected between the other end of the second offset capacitor and the input node of the second potential, a sixth switch connected between the other end of the second offset capacitor and the input node of the first potential, a seventh switch connected between the negative input of the second operational amplifier and an output thereof, and an eighth switch connected between the output of the second operational amplifier and the output line.

5. The constant-voltage generating circuit according to claim 1, wherein the first amplifier unit includes a first phase compensation capacitor and a second phase compensation capacitor, and the second amplifier unit includes a third phase compensation capacitor and a fourth phase compensation capacitor, and wherein the first amplifier unit connects the first phase compensation capacitor to the output and disconnects the second phase compensation capacitor from the output during the first operation period, and connects the second phase compensation capacitor to the output and disconnects the first phase compensation capacitor from the output during the second operation period, and the second amplifier unit connects the third phase compensation capacitor to the output and disconnects the fourth phase compensation capacitor from the output during the first operation period, and connects the fourth phase compensation capacitor to the output and disconnects the third phase compensation capacitor from the output during the second operation period.

6. The constant-voltage generating circuit according to claim 2, wherein the first amplifier unit includes a first phase compensation capacitor and a second phase compensation capacitor, and the second amplifier unit includes a third phase compensation capacitor and a fourth phase compensation capacitor, and wherein the first amplifier unit connects the first phase compensation capacitor to the output and disconnects the second phase compensation capacitor from the output during the first operation period, and connects the second phase compensation capacitor to the output and disconnects the first phase compensation capacitor from the output during the second operation period, and the second amplifier unit connects the third phase compensation capacitor to the output and disconnects the fourth phase compensation capacitor from the output during the first operation period, and connects the fourth phase compensation capacitor to the output and disconnects the third phase compensation capacitor from the output during the second operation period.

7. The constant-voltage generating circuit according to claim 3, wherein the first amplifier unit includes a first phase compensation capacitor and a second phase compensation capacitor, and the second amplifier unit includes a third phase compensation capacitor and a fourth phase compensation capacitor, and wherein the first amplifier unit connects the first phase compensation capacitor to the output and disconnects the second phase compensation capacitor from the output during the first operation period, and connects the second phase compensation capacitor to the output and disconnects the first phase compensation capacitor from the output during the second operation period, and the second amplifier unit connects the third phase compensation capacitor to the output and disconnects the fourth phase compensation capacitor from the output during the first operation period, and connects the fourth phase compensation capacitor to the output and disconnects the third phase compensation capacitor from the output during the second operation period.

8. The constant-voltage generating circuit according to claim 4, wherein the first amplifier unit includes a first phase compensation capacitor and a second phase compensation capacitor, and the second amplifier unit includes a third phase compensation capacitor and a fourth phase compensation capacitor, and wherein the first amplifier unit connects the first phase compensation capacitor to the output and disconnects the second phase compensation capacitor from the output during the first operation period, and connects the second phase compensation capacitor to the output and disconnects the first phase compensation capacitor from the output during the second operation period, and the second amplifier unit connects the third phase compensation capacitor to the output and disconnects the fourth phase compensation capacitor from the output during the first operation period, and connects the fourth phase compensation capacitor to the output and disconnects the third phase compensation capacitor from the output during the second operation period.

9. The constant-voltage generating circuit according to claim 1, further comprising a switch provided between the output line and the low-pass filter, and wherein the switch is turned off for a predetermined period of time in an early stage of each of the first and second operation periods.

10. The constant-voltage generating circuit according to claim 2, further comprising a switch provided between the output line and the low-pass filter, and wherein the switch is turned off for a predetermined period of time in an early stage of each of the first and second operation periods.

11. The constant-voltage generating circuit according to claim 3, further comprising a switch provided between the output line and the low-pass filter, and wherein the switch is turned off for a predetermined period of time in an early stage of each of the first and second operation periods.

12. The constant-voltage generating circuit according to claim 4, further comprising a switch provided between the output line and the low-pass filter, and wherein the switch is turned off for a predetermined period of time in an early stage of each of the first and second operation periods.

13. The constant-voltage generating circuit according to claim 5, further comprising a switch provided between the output line and the low-pass filter, and wherein the switch is turned off for a predetermined period of time in an early stage of each of the first and second operation periods.

14. The constant-voltage generating circuit according to claim 6, further comprising a switch provided between the output line and the low-pass filter, and wherein the switch is turned off for a predetermined period of time in an early stage of each of the first and second operation periods.

15. The constant-voltage generating circuit according to claim 7, further comprising a switch provided between the output line and the low-pass filter, and wherein the switch is turned off for a predetermined period of time in an early stage of each of the first and second operation periods.

16. The constant-voltage generating circuit according to claim 8, further comprising a switch provided between the output line and the low-pass filter, and wherein the switch is turned off for a predetermined period of time in an early stage of each of the first and second operation periods.

17. The constant-voltage generating circuit according to claim 3, wherein the first amplifier unit includes a ninth switch provided in parallel with the first offset capacitor, and wherein for a predetermined time after power on, the ninth switch is turned on, and only the first amplifier unit is operated, while the second amplifier unit is held in an inoperative condition, and when the predetermined time has elapsed, the ninth switch is turned off, and the operation alternating between the first operation period and the second operation period is started.

18. The constant-voltage generating circuit according to claim 4, wherein the first amplifier unit includes a ninth switch provided in parallel with the first offset capacitor, and wherein for a predetermined time after power on, the ninth switch is turned on, and only the first amplifier unit is operated, while the second amplifier unit is held in an inoperative condition, and when the predetermined time has elapsed, the ninth switch is turned off, and the operation alternating between the first operation period and the second operation period is started.

19. A regulator circuit comprising a constant-voltage generating circuit for generating a reference voltage, an error amplifier, an output transistor controlled by an output of the error amplifier, and a resistive voltage-dividing circuit for dividing a regulator output voltage, wherein the error amplifier performs negative feedback control by comparing the voltage divided by the resistive voltage-dividing circuit with the reference voltage, and wherein the constant-voltage generating circuit is a constant-voltage generating circuit comprising:

a reference potential generating unit which outputs a prescribed first potential that varies with a positive or negative temperature dependence in accordance with a potential on an output line, and a second potential that varies with an opposite temperature dependence to the positive or negative temperature dependence with respect to the potential on the output line;

a first amplifier unit which takes the first potential and the second potential as two inputs, and whose output is connected to the output line during a first operation period;

a second amplifier unit which takes the first potential and the second potential as two inputs, and whose output is connected to the output line during a second operation period; and a low-pass filter connected to the output line, and wherein the first operation period and the second operation period are repeated, one alternating with the other, the first amplifier unit stores offset voltage of the first amplifier unit during the second operation period, and produces an output, during the first operation period, that brings the first potential and the second potential equal to each other by canceling out the offset voltage using the stored offset voltage, and the second amplifier unit stores offset voltage of the second amplifier unit during the first operation period, and produces an output, during the second operation period, that brings the first potential and the second potential equal to each other by canceling out the offset voltage using the stored offset voltage.

* * * * *